US011655623B2

(12) United States Patent
Tamura

(10) Patent No.: US 11,655,623 B2
(45) Date of Patent: May 23, 2023

(54) NOZZLE FOR SANITARY CLEANING DEVICE

(71) Applicant: LIXIL Corporation, Tokyo (JP)

(72) Inventor: Hideki Tamura, Tokyo (JP)

(73) Assignee: LIXIL Corporation, Tokyo (JP)

( * ) Notice: Subject to any disclaimer, the term of this patent is extended or adjusted under 35 U.S.C. 154(b) by 97 days.

(21) Appl. No.: 17/157,517

(22) Filed: Jan. 25, 2021

(65) Prior Publication Data

US 2021/0230855 A1 Jul. 29, 2021

(30) Foreign Application Priority Data

Jan. 27, 2020 (JP) ..... JP2020-011117

(51) Int. Cl.
*B05B 1/20* (2006.01)
*E03D 9/08* (2006.01)
*B05B 15/658* (2018.01)

(52) U.S. Cl.
CPC ..... *E03D 9/08* (2013.01); *B05B 1/20* (2013.01); *B05B 15/658* (2018.02)

(58) Field of Classification Search
CPC ..... E03D 9/08; B05B 1/20; B05B 15/658
USPC ..... 239/56
See application file for complete search history.

(56) References Cited

U.S. PATENT DOCUMENTS 4,242,764 A * 1/1981 Fukuda ..... E03D 9/08 4/233
4,287,618 A * 9/1981 Silver ..... A47K 3/022 4/444
4,841,582 A * 6/1989 Matsui ..... E03D 9/08 4/445
5,199,649 A * 4/1993 Tol ..... B05B 15/65 239/597
5,359,736 A * 11/1994 Olivier ..... E03D 9/08 4/443
7,770,820 B2 * 8/2010 Clearman ..... B05B 1/185 239/222.11
9,198,542 B2 * 12/2015 Frei ..... A47K 3/26

FOREIGN PATENT DOCUMENTS

JP 2003-278248 A 10/2003

* cited by examiner

*Primary Examiner* — Chee-Chong Lee
(74) *Attorney, Agent, or Firm* — Morrison & Foerster LLP

(57) ABSTRACT

The present disclosure is intended to provide a nozzle for a sanitary cleaning device, the nozzle being configured such that the positioning of a channel-forming member can be easily performed in an axial direction of a nozzle cover. The nozzle is for used for a sanitary cleaning device, and includes: a nozzle cover made of ceramic and having a nozzle cover-side water ejection opening; a distal-side channel-forming component disposed in the nozzle cover and having a channel-side water ejection opening which communicates with the nozzle cover-side water ejection opening; and a rear-side channel-forming components connected to a rear portion of the distal-side channel-forming component in an axial direction of the nozzle cover, and capable of being adjusted in position in the axial direction of the nozzle cover with respect to the distal-side channel-forming component.

9 Claims, 11 Drawing Sheets

NOZZLE FOR SANITARY CLEANING DEVICE

CROSS-REFERENCE TO RELATED APPLICATIONS

This application claims the priority of Japanese Patent Application No. 2020-011117, filed Jan. 27, 2020, the entire contents of which are incorporated herein by reference.

FIELD OF THE DISCLOSURE

The present disclosure relates to a nozzle for a sanitary cleaning device.

BACKGROUND OF THE DISCLOSURE

Nozzles for sanitary cleaning devices have been known. A known nozzle includes a cylindrical nozzle cover having a nozzle cover-side water ejection opening, and a channel forming member disposed in the nozzle cover and having a channel-side water ejection opening (see, for example, Patent Document 1). In a state where the nozzle cover has the channel-forming member disposed therein, the nozzle cover-side water ejection opening of the nozzle cover and the channel-side water ejection opening of the channel-forming member may need to communicate with each other while coinciding in position with each other in the axial direction of the nozzle cover. Accordingly, highly precise positioning is required.

Patent Document 1: Japanese Unexamined Patent Application, Publication No. 2003-278248

SUMMARY OF THE DISCLOSURE

If a nozzle cover is made of ceramic, the nozzle cover is likely to have dimensional deviations caused by the manufacturing process. When the channel-forming member is arranged in the nozzle cover, such a dimensional deviation in the axial dimension of the nozzle cover may make it difficult to perform positioning of the channel-forming member in the axial direction.

It is an object of the present disclosure to provide a nozzle for a sanitary cleaning device, the nozzle including a ceramic nozzle cover and a channel-forming member which is disposed in the nozzle cover, and positioning of which can be easily performed in the axial direction even if the nozzle cover has a dimensional deviation in the axial direction.

An aspect of the present disclosure is directed to a nozzle for a sanitary cleaning device. The nozzle includes: a nozzle cover made of ceramic and having a nozzle cover-side water ejection opening; a distal-side channel-forming component disposed in the nozzle cover and having a channel-side water ejection opening which communicates with the nozzle cover-side water ejection opening; and a rear-side channel-forming component connected to a rear portion of the distal-side channel-forming component in an axial direction of the nozzle cover, and capable of being adjusted in position in the axial direction of the nozzle cover with respect to the distal-side channel-forming component.

DETAILED DESCRIPTION OF THE DISCLOSURE

Figure 1:
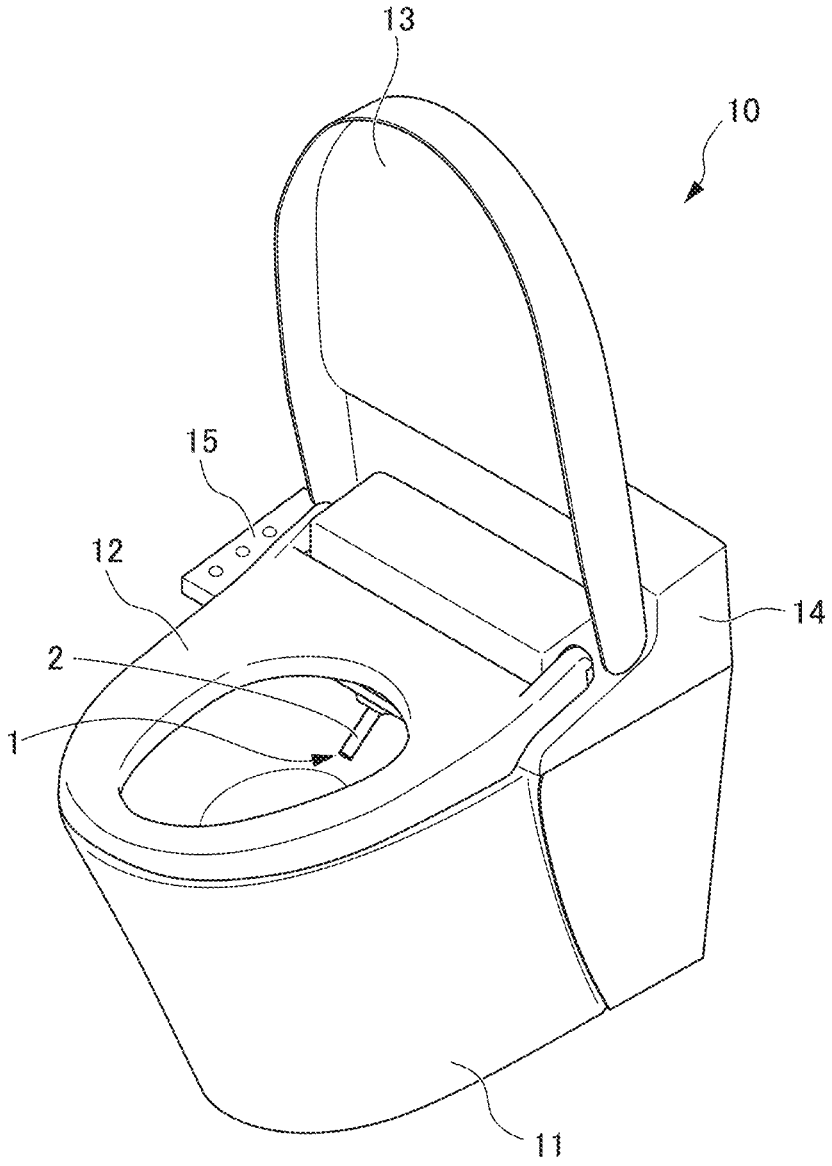
FIG. 1 is a perspective view of a toilet apparatus mounted with a nozzle of a first embodiment.

A toilet apparatus 10 provided with a sanitary cleaning device 1 that includes a nozzle 2 of a first embodiment will be described with reference to the accompanying drawings. In the following description, the words, such as "front", "forward", "rear" and "rearward", refer to the respective direction as viewed from a user seated on a toilet seat 12. As shown in FIG. 1, the sanitary cleaning device 1 of the present embodiment is mounted to the toilet apparatus 10. The toilet apparatus 10 includes a toilet bowl 11, the toilet seat 12, a toilet lid 13, a functional unit 14, and an operation panel 15.

The toilet bowl 11 has an opening facing upward, and is made of, for example, ceramic. The toilet seat 12 and the toilet lid 13 are attached to a front portion of the functional unit 14 such that the toilet seat 12 and the toilet lid 13 are pivotable with respect to the toilet bowl 11. The toilet seat 12 is a part on which a user is seated. The toilet seat 12 is placed on the rim of the opening of the toilet bowl 11. The toilet seat 12 has a ring shape. The toilet lid 13 covers the opening of the toilet bowl 11 and the opening of the toilet seat 12 in an openable/closable manner. The functional unit 14 has the toilet seat 12 and the toilet lid 13 attached thereto, and the sanitary cleaning device 1 installed thereon.

The operation panel 15 extends from the functional unit 14 and disposed on a side of the toilet seat 12 adjacent to the functional unit 14. The operation panel 15 is operable to flush the toilet bowl 11, to cause the sanitary cleaning device 1 to perform a cleaning, and to select cleaning modes of the sanitary cleaning device 1.

Figure 2A:
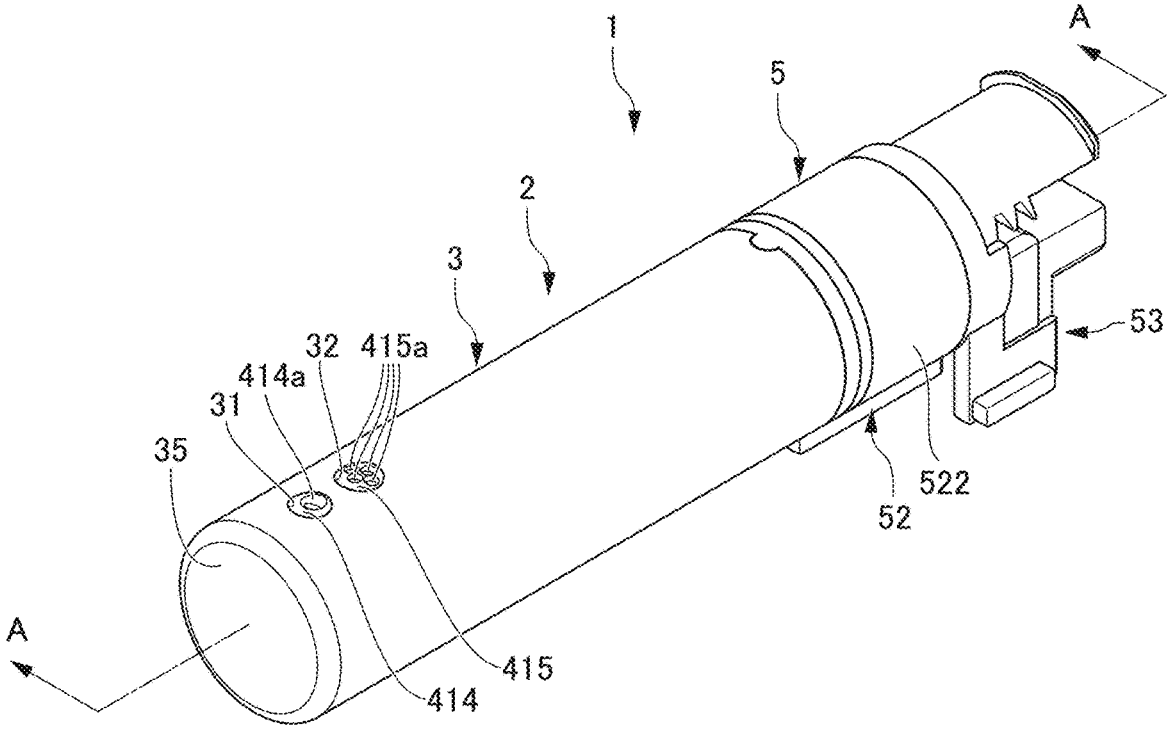
FIG. 2A is a perspective view of the nozzle and a nozzle support, as viewed from a distal end.
Figure 2B:
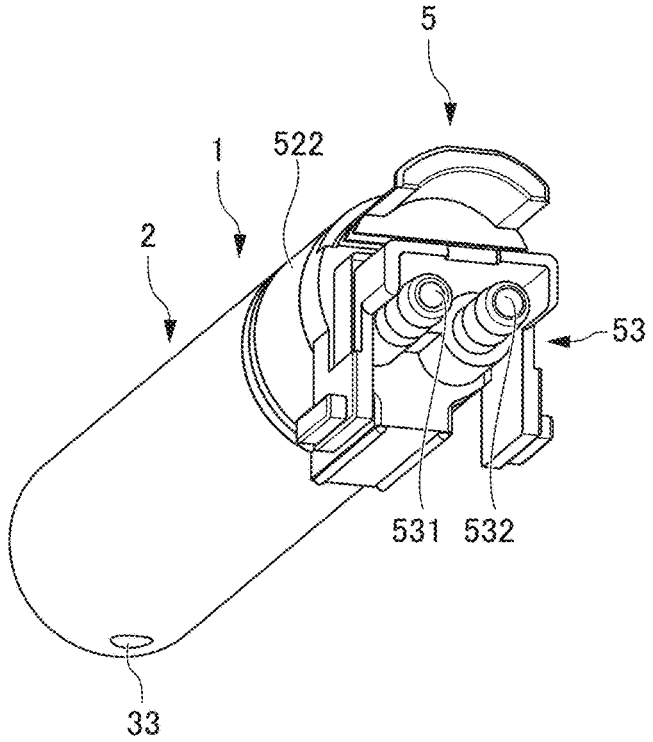
FIG. 2B is a perspective view of the nozzle and the nozzle support, as viewed from a proximal end.

The sanitary cleaning device 1 is configured to wash the private parts of a person. The sanitary cleaning device 1 is disposed in a rearward area in the opening of the toilet seat 12 and on the front end side of the functional unit 14. As shown in FIGS. 2A and 2B, the sanitary cleaning device 1 includes the nozzle 2 that is configured to eject cleaning water, and a nozzle support 5 that supports the nozzle 2 in an extendable/retractable manner. The nozzle 2 is for use in the sanitary cleaning device 1. The nozzle 2 is usable for cleaning the genital and anal area of a person.

Figure 3:
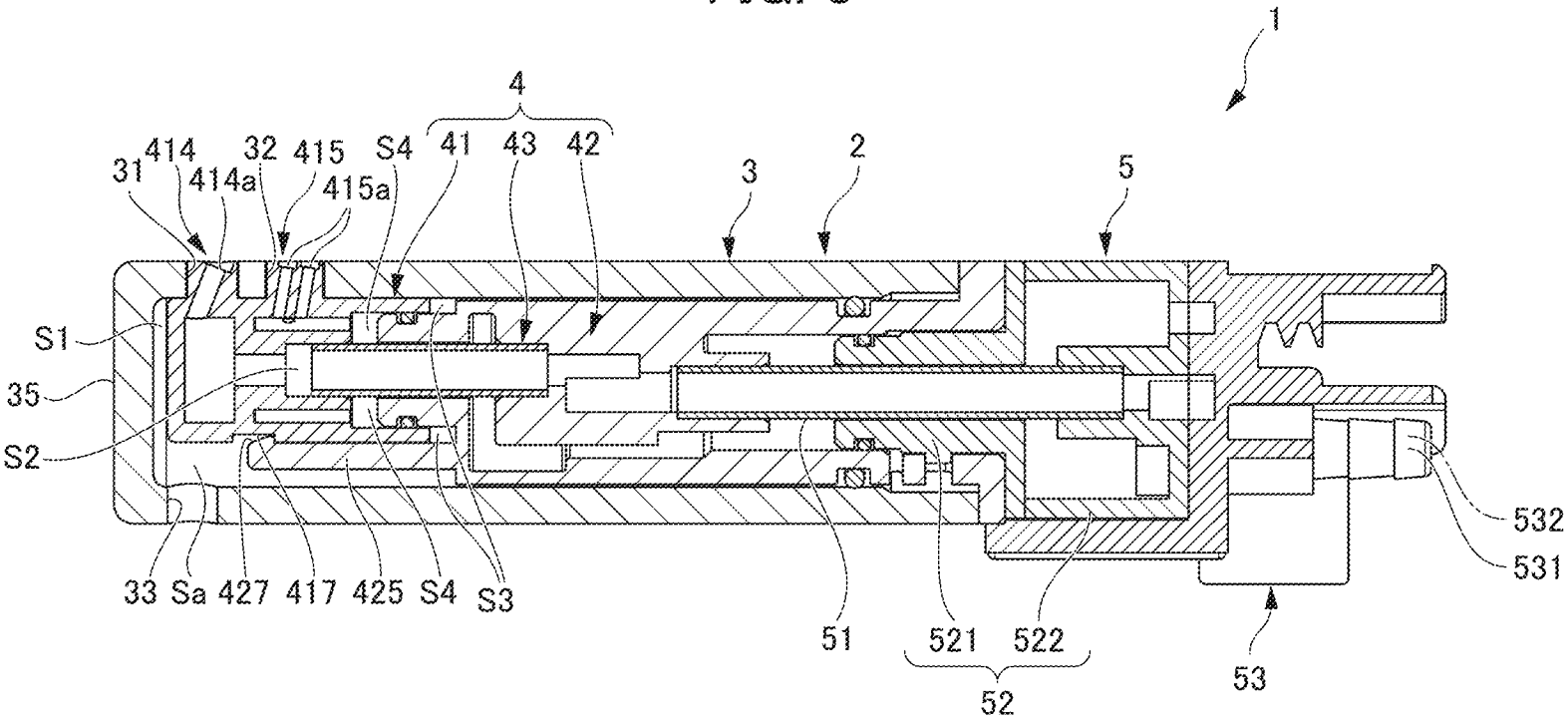
FIG. 3 is a cross-sectional view taken along line A-A in FIG. 2A.

The nozzle support 5 supports the proximal end of the nozzle 2. As shown in FIG. 3, the nozzle support 5 has a cleaning water introduction pipe 51, a nozzle mount 52, and a rear slidable part 53. The nozzle mount 52 has a small-diameter mount part 521 and a large-diameter rear part 522.

Figure 4:
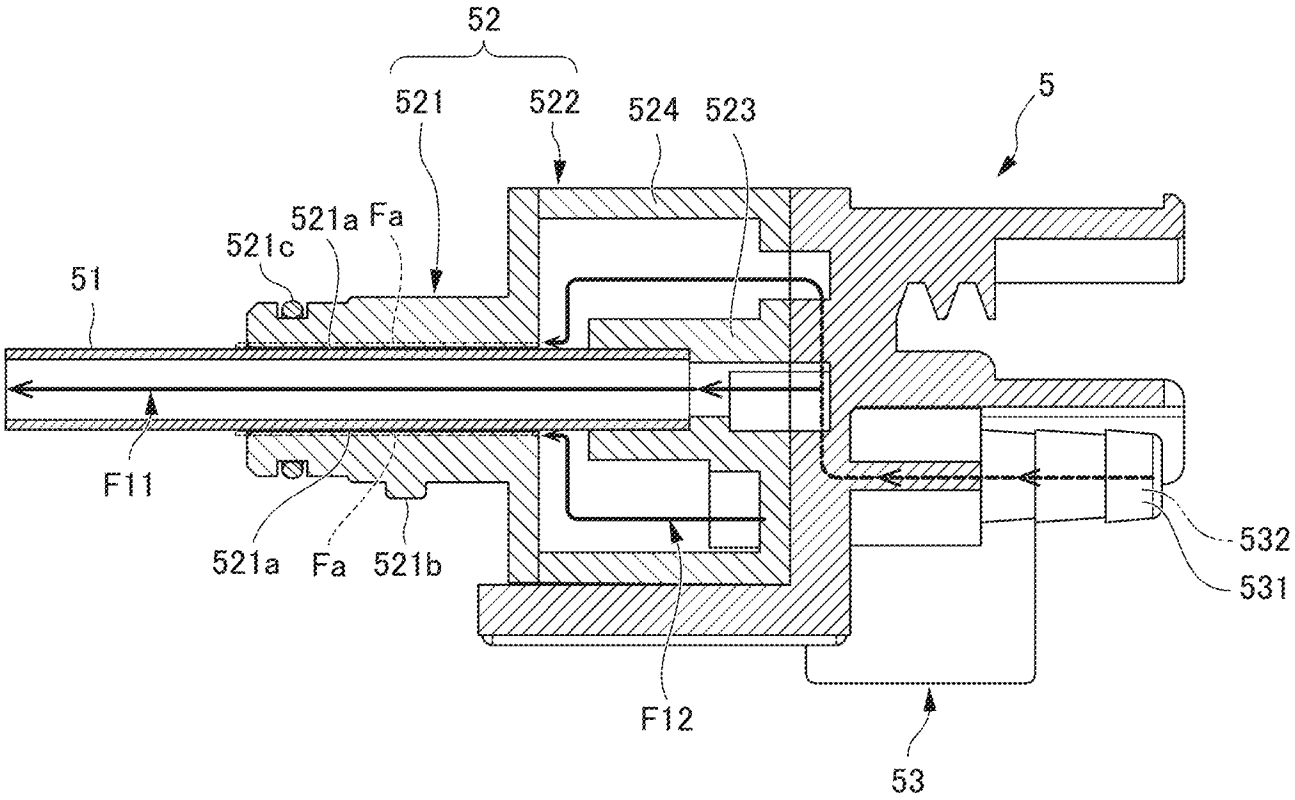
FIG. 4 is a cross-sectional view of the nozzle support.

As shown in FIG. 3, the small-diameter mount part 521 constitutes a distal end portion of the nozzle support 5, and has a cylindrical shape. As shown in FIG. 4, the small-diameter mount part 521 has a fitting protrusion 521*b* on its outer peripheral surface. The fitting protrusion 521*b* is configured to fit in a nozzle-side fitting recess 21 of the nozzle 2 (see FIG. 5). An O-ring 521C is attached to the outer peripheral surface of the small-diameter mount part 521.

As shown in FIG. 4, the cleaning water introduction pipe 51 passes through the small-diameter mount part 521 to extend along the inner peripheral surface of the small-diameter mount part 521. The inner peripheral surface of the small-diameter mount part 521 has a plurality of ribs 521*a* formed thereon. The plurality of ribs 521*a* are spaced apart from each other in the circumferential direction and extend in the axial direction. In a state where the cleaning water introduction pipe 51 has been fitted along the inner peripheral surface of the small-diameter mount part 521, the plurality of ribs 521*a* are in contact with the outer peripheral surface of the cleaning water introduction pipe 51. As the result, intra-support gap channels Fa through which cleaning water flows are formed between the outer peripheral surface of the cleaning water introduction pipe 51 and the inner peripheral surface of the small-diameter mount part 521.

The cleaning water introduction pipe 51 has a cylindrical shape extending in the axial direction of the nozzle 2. The cleaning water introduction pipe 51 has an axial rear end portion connected to the large-diameter rear part 522 of the nozzle mount 52 by having been press-fitted and inserted into the large-diameter rear part 522, while having an axially intermediate portion penetrating the inside of the small-diameter mount part 521. In a state where the nozzle 2 has been connected to the nozzle support 5, the cleaning water introduction pipe 51 has an axially distal end portion connected to an introduction-side channel interior cylindrical wall 424 (to be described later; see FIG. 5) of an introduction-side channel-forming component 42 of the nozzle 2 by having been press-fitted and inserted into the introduction-side channel interior cylindrical wall 424.

The rear end portion of the cleaning water introduction pipe 51 is press-fitted into the large-diameter rear part 522 of the nozzle mount 52, and constitutes a water-tight structure functioning as a seal between the cleaning water introduction pipe 51 and the large-diameter rear part 522 of the nozzle mount 52. The distal end portion of the cleaning water introduction pipe 51 is press-fitted into the introduction-side channel interior cylindrical wall 424 of the introduction-side channel-forming component 42 of the nozzle 2, and constitutes a water-tight structure functioning as a seal between the cleaning water introduction pipe 51 and the introduction-side channel interior cylindrical wall 424 of the introduction-side channel-forming component 42 of the nozzle 2.

As shown in FIG. 4, the large-diameter rear part 522 is connected to the proximal end of the small-diameter mount part 521, and has a cylindrical shape. The large-diameter rear part 522 has an inner cylinder 523 opening forward, and an outer cylinder 524 disposed outside the inner cylinder 523.

The rear slidable part 53 is connected to the rear end of the nozzle mount 52. The rear slidable part 53 is mounted to the sanitary cleaning device 1 in an extendable/retractable manner. As shown in FIG. 2B, a central cleaning-water introduction part 531 and an outer cleaning-water introduction part 532 are provided at the rear end of the rear slidable part 53.

The central cleaning-water introduction part 531 is an inlet port through which cleaning water is introduced to flow in the axial direction through a radially central portion of the nozzle 2. The central cleaning-water introduction part 531 has an open rear end, as shown in FIG. 2A, and a front end communicating with the interior space of the inner cylinder 523 of the large-diameter rear part 522, as shown in FIG. 4. The outer cleaning-water introduction part 532 is an inlet port through which cleaning water is introduced to flow in the axial direction through a radially outer portion of the nozzle 2. The outer cleaning-water introduction part 532 has an open rear end, as shown in FIG. 2B, and a front end communicating with the space between the outer cylinder 524 and the inner cylinder 523 of the large-diameter rear part 522, as shown in FIG. 4.

As shown in FIG. 4, the nozzle support 5 has therein an intra-support inner introduction channel F11 and an intra-support outer introduction channel F12. The intra-support inner introduction channel F11 allows cleaning water, which has been introduced through the central cleaning-water introduction part 531, to pass through the interior space of the inner cylinder 523 of the large-diameter rear part 522 and the inside of the cleaning water introduction pipe 51, and to enter an intra-nozzle introduction-side inner channel F21 (to be described later; see FIG. 5) of the nozzle 2.

The intra-support outer introduction channel F12 allows cleaning water, which has been introduced through the outer cleaning-water introduction part 532, to pass through the space between the inner cylinder 523 and the outer cylinder 524 of the large-diameter rear part 522 and the intra-support gap channels Fa between the inner peripheral surface of the small-diameter mount part 521 and the outer peripheral surface of the cleaning water introduction pipe 51, and to enter an intra-nozzle introduction-side outer channel F22 (to be described later; see FIG. 5) of the nozzle 2.

As shown in FIGS. 2A and 2B, the proximal end of the nozzle 2 is supported on the nozzle support 5. The nozzle 2 has the shape of a long circular column and extends in the axial direction. The nozzle 2 has, on its upper surface near the distal end, a first water-ejection opening 414*a* and a second water-ejection opening 415*a* that are aligned in the axial direction. The first water-ejection opening 414*a* and the second water-ejection opening 415*a* are configured to eject cleaning water supplied from a warm water supply unit (not shown).

As shown in FIGS. 3 and 5 to 7, the nozzle 2 includes a cylindrical nozzle cover 3 and a channel-forming member 4 disposed in the nozzle cover 3. The channel-forming member 4 has an ejection-side channel-forming component 41 (first channel-forming component), an introduction-side channel-forming component 42 (rear-side channel-forming component, second channel-forming component), and a connection pipe 43 (rear-side channel-forming component) that connects the ejection-side channel-forming component 41 and the introduction-side channel-forming component 42 to each other.

The nozzle cover 3 has a cylindrical shape a distal end of which is closed with a distal end closing plate 35, and a proximal end of which is open. The nozzle cover 3 is made of ceramic. The ejection-side channel-forming component 41, the introduction-side channel-forming component 42, and the connection pipe 43 are each made of, for example, a resin material.

The nozzle cover 3 has, on its upper surface near the distal end, a first through-hole 31 (nozzle cover-side water ejection opening) and a second through-hole 32 (nozzle cover-side water ejection opening). The nozzle cover 3 has, on its lower surface, a lower surface opening 33. The lower surface opening 33 is a drainage opening for draining water in the nozzle cover 3 to the outside. When the nozzle 2 is assembled, the lower surface opening 33 is also usable as a hole through which a rod-shaped jig J can be inserted to move the ejection-side channel-forming component 41 toward an upper side, as will be described later (see FIG. 8B).

Figure 5:
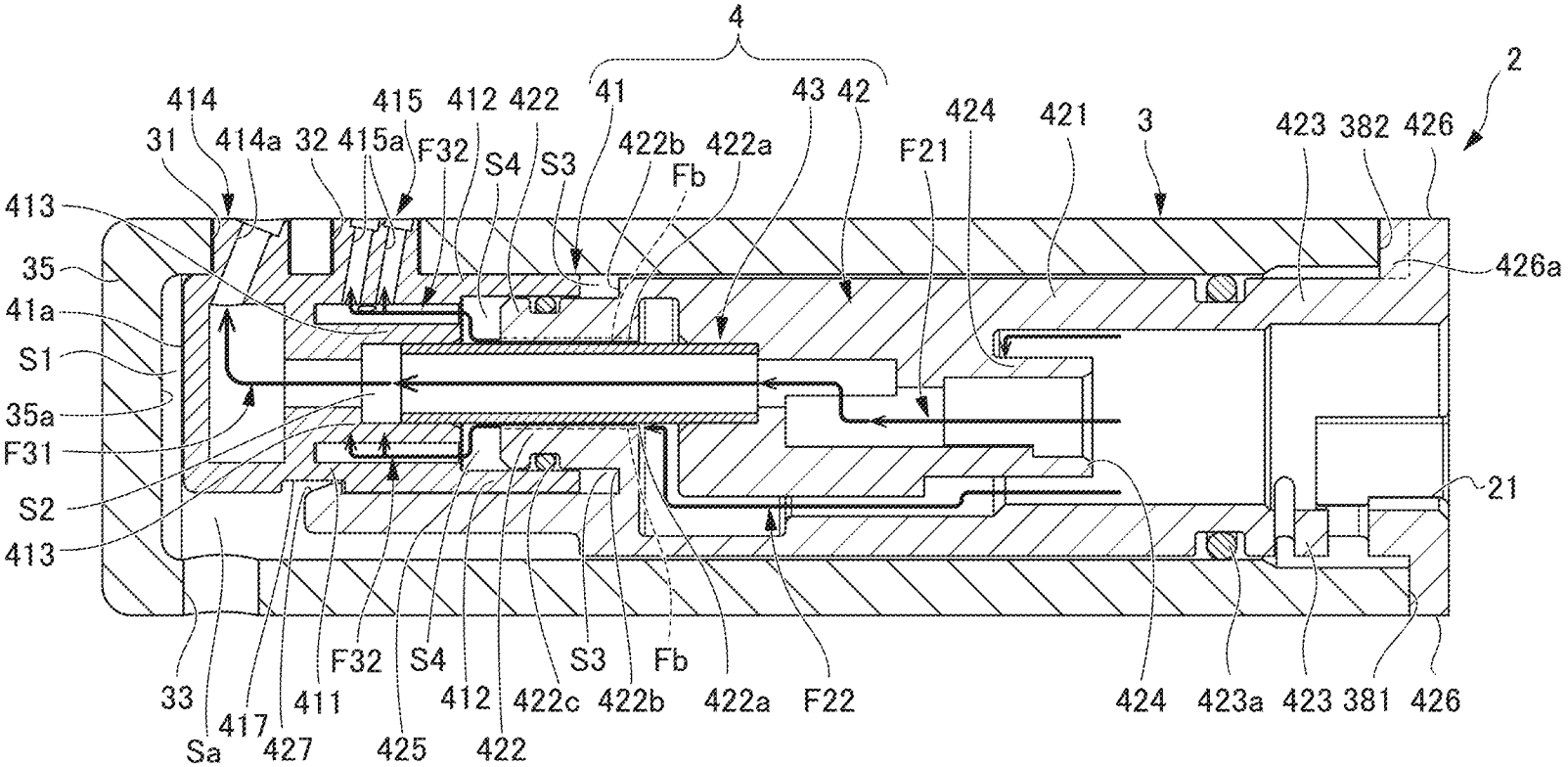
FIG. 5 is a cross-sectional view of the nozzle.
Figure 6:
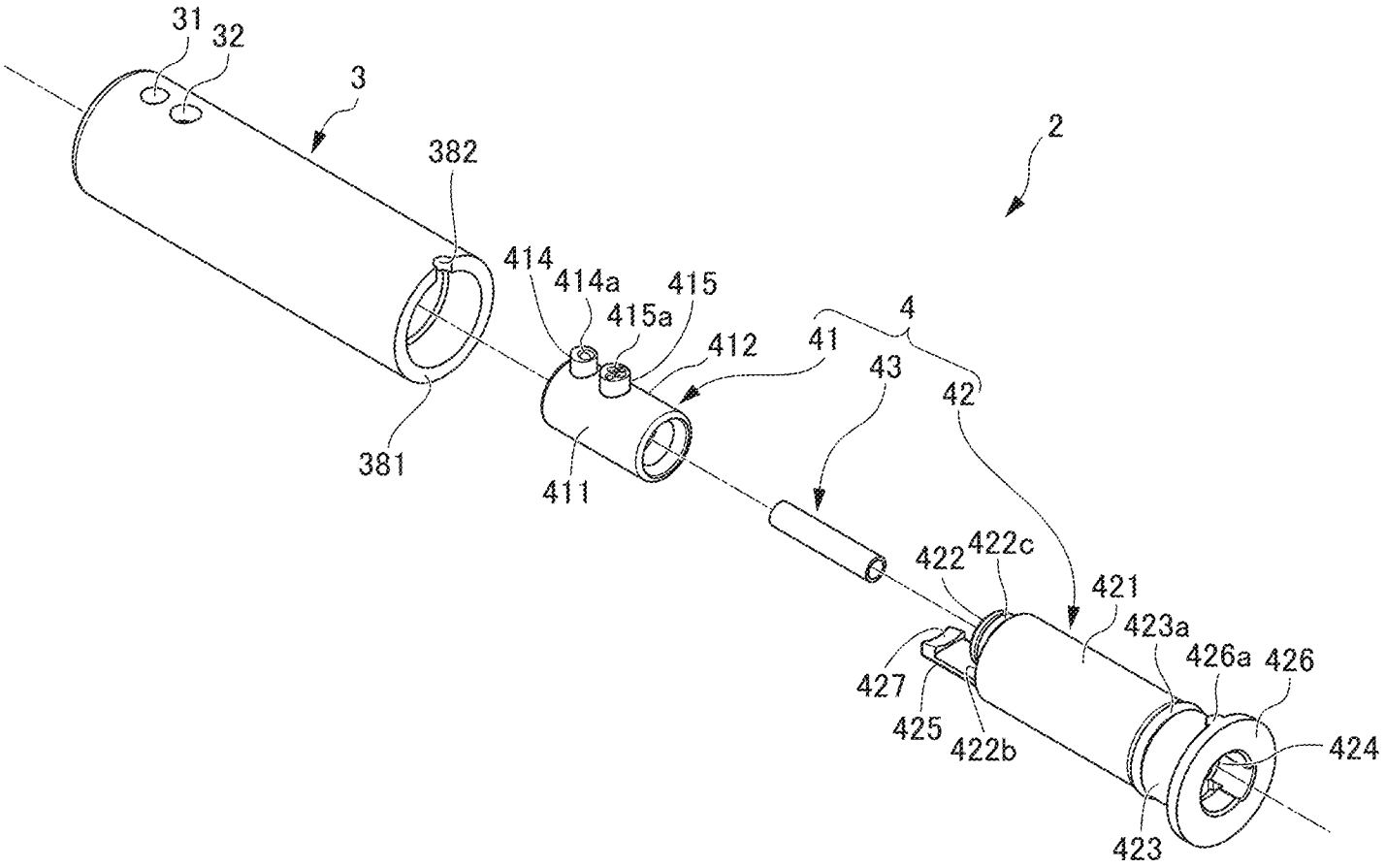
FIG. 6 is an exploded perspective view of the nozzle, as viewed obliquely from above.

As shown in FIGS. 5 and 6, the first and second through-holes 31 and 32 are aligned in the axial direction of the nozzle 2 on the upper surface of the nozzle cover 3 near the distal end. The first and second through-holes 31 and 32 pass through the nozzle cover 3 in a thickness direction. The first and second through-holes 31 and 32 extend in a radial direction of the nozzle cover 3 for a distance corresponding to the thickness of the nozzle cover 3. The first through-hole 31 receives a first water-ejection protrusion 414 (to be described later) fitted therein, the first water-ejection protrusion 414 being provided on the ejection-side channel-forming component 41 of the channel-forming member 4 housed in the nozzle cover 3. The second though-hole 32 receives a second water-ejection protrusion 415 (to be described later) fitted therein, the second water-ejection protrusion 415 being provided on the ejection-side channel-forming component 41 of the channel-forming member 4 housed in the nozzle cover 3. In this manner, positioning of the ejection-side channel-forming component 41 is performed with respect to the nozzle cover 3.

The nozzle cover 3 has a reference surface 381 (reference position) formed at a reference position and a circumferential-positioning notch 382. The reference surface 381 is constituted of a rear end face of the nozzle cover 3. The reference surface 381 is in contact with a flange 426 of the introduction-side channel-forming component 42 (to be described later). The circumferential-positioning notch 382 has a semi-circular shape recessed from the reference surface 381 toward the distal end. The circumferential-positioning notch 382 is engaged with a circumferential-positioning projection 426*a* of the flange 426 of the introduction-side channel-forming component 42 (to be described later).

As shown in FIG. 5, the ejection-side channel-forming component 41, the introduction-side channel-forming component 42, and the connection pipe 43 are housed in the nozzle cover 3. The ejection-side channel-forming component 41 and the introduction-side channel-forming component 42 are aligned in the axial direction of the nozzle cover 3. In the nozzle cover 3, the ejection-side channel-forming component 41 is disposed adjacent to the axially distal end and the upper side of the nozzle 2. In the nozzle cover 3, the upper side refers to the area that is located inside the nozzle cover 3 and that includes the first through-hole 31 and the second through-hole 32. In the nozzle cover 3, the introduction-side channel-forming component 42 is disposed adjacent to the axially proximal end of the nozzle cover 3. The connection pipe 43 has a cylindrical shape extending in the axial direction of the nozzle cover 3 and connects the ejection-side channel-forming component 41 to the introduction-side channel-forming component 42.

In the nozzle cover 3, the introduction-side channel-forming component 42 is disposed at the proximal end (rear end) of the ejection-side channel-forming component 41 (to be described later), which is disposed adjacent to the distal end of the nozzle cover 3. The distal end portion of the introduction-side channel-forming component 42 is fixed in place to the ejection-side channel-forming component 41. The introduction-side channel-forming component 42 is fixed to the nozzle cover 3. In the present embodiment, for example, the front surface of the flange 426 (to be described later) of the introduction-side channel-forming component 42 is positioned, with respect to the axial direction of the nozzle cover 3, on the reference surface 381 at the rear end of the nozzle cover 3, and is fixed to the nozzle cover 3 by bonding. In another embodiment, the fixing may be achieved by press-fitting.

Figure 7:
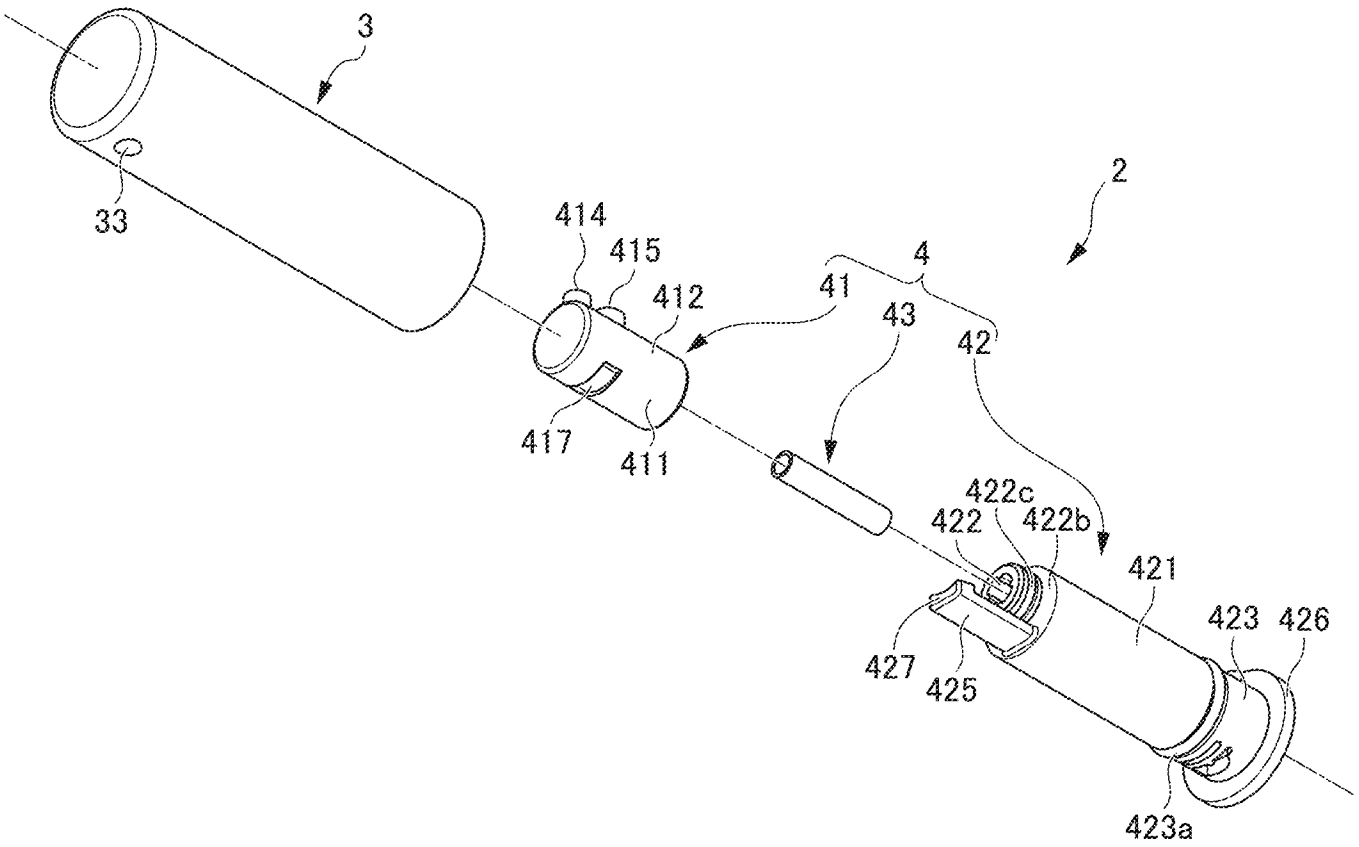
FIG. 7 is an exploded perspective view of the nozzle, as viewed obliquely from below.

As shown in FIGS. 5 to 7, the introduction-side channel-forming component 42 has an introduction-side channel body 421, a distal-side extension 425 (gap-insertion portion), and the flange 426 formed at the proximal end. The distal-side extension 425 extends toward the distal end from a lower portion of the distal end of the introduction-side channel body 421, and has a predetermined width in a direction perpendicular to the axial direction of the nozzle cover 3. In a state where the distal end portion of the introduction-side channel-forming component 42 has been connected to the proximal end portion of the ejection-side channel-forming component 41, the distal-side extension 425 is disposed in a lower gap Sa (engagement gap, fitting gap) between a lower portion of the ejection-side channel-forming component 41 (to be described later) and the nozzle cover 3. The lower portion of the ejection-side channel-forming component 41 refers to a portion of the ejection-side channel-forming component 41 disposed close to the upper side in the nozzle cover 3, the portion being located opposite to the first and second through-holes 31 and 32 of the nozzle cover 3 in a radial direction, and facing downward.

As shown in FIGS. 5 to 7, the distal-side extension 425 has, at its distal end, a distal-side engagement protrusion 427 (second engagement portion) protruding toward the ejection-side channel-forming component 41. When the introduction-side channel-forming component 42 is fixed in place to the ejection-side channel-forming component 41 (to be described later) in the nozzle cover 3, the distal-side engagement protrusion 427 is fixedly engaged with an ejection-side engagement recess 417 (to be described later) of the ejection-side channel-forming component 41. The distal-side engagement protrusion 427 protrudes upward from the upper surface of the distal end of the distal-side extension 425. The distal-side engagement protrusion 427 has a predetermined width in the axial direction of the nozzle cover 3, and extends in a direction perpendicular to the axial direction of the nozzle cover 3 for a distance equal to the width of the distal-side extension 425. The upper surface of the distal-side engagement protrusion 427 has an arc shape curved downward along the circumference of the nozzle cover 3.

The introduction-side channel body 421 has a substantially cylindrical outer shape. The introduction-side channel body 421 has an introduction-side channel distal-side cylindrical wall 422 formed at the distal end thereof, an introduction-side channel proximal-side outer cylindrical wall 423 formed at the proximal end thereof, and the introduction-side channel interior cylindrical wall 424 formed inside the introduction-side channel proximal-side outer cylindrical wall 423.

The introduction-side channel distal-side cylindrical wall 422 is formed at the end of the introduction-side channel body 421, the end portion being located adjacent to the distal end of the nozzle cover 3. The introduction-side channel distal-side cylindrical wall 422 has a cylindrical shape the outer peripheral surface of which is smaller in diameter than the outer peripheral surface of the introduction-side channel body 421 by the height of a step. The introduction-side channel distal-side cylindrical wall 422 extends from the outer peripheral surface of the introduction-side channel body 421 with a step end face 422*b* interposed therebetween, and extends cylindrically toward the distal end from a point located inside with respect to the outer peripheral surface of the introduction-side channel body 421 by the height of the step.

The introduction-side channel distal-side cylindrical wall 422 opens toward the ejection-side channel-forming component 41 (to be described later). An O-ring 422*c* (watertight structure) is attached to the outer peripheral surface of the introduction-side channel distal-side cylindrical wall 422. To connect the introduction-side channel-forming component 42 to the ejection-side channel-forming component 41, the outer peripheral surface of the introduction-side channel distal-side cylindrical wall 422 is fitted to an ejection-side channel outer cylindrical wall 412 of an ejection-side channel body 411. A rear end portion of the connection pipe 43 is fitted to the inner peripheral surface of the introduction-side channel distal-side cylindrical wall 422.

The introduction-side channel distal-side cylindrical wall 422 has a plurality of ribs 422*a* formed on the inner peripheral surface thereof. The plurality of ribs 422*a* are spaced apart from each other in the circumferential direction, and extend in the axial direction. In a state where the connection pipe 43 has been fitted along the inner peripheral surface of the introduction-side channel distal-side cylindrical wall 422, the plurality of ribs 422*a* are in contact with the outer peripheral surface of the connection pipe 43. As the result, intra-nozzle gap channels Fb through which cleaning water flows are formed between the outer peripheral surface of the connection pipe 43 and the inner peripheral surface of the introduction-side channel distal-side cylindrical wall 422. The rear end of the connection pipe 43 is fixed to a point located inward relative to the introduction-side channel distal-side cylindrical wall 422.

The introduction-side channel proximal-side outer cylindrical wall 423 is formed at an end of the introduction-side channel body 421, the end being adjacent to the proximal end of the nozzle cover 3. The introduction-side channel proximal-side outer cylindrical wall 423 opens toward the nozzle support 5. To connect the introduction-side channel-forming component 42 to the nozzle support 5, the distal end portion of the nozzle support 5 is fitted to the inner peripheral surface of the introduction-side channel proximal-side outer cylindrical wall 423. An O-ring 423*a* is attached to the outer peripheral surface of the introduction-side channel proximal-side outer cylindrical wall 423.

The introduction-side channel interior cylindrical wall 424 is disposed in the introduction-side channel proximal-side outer cylindrical wall 423 in an axially intermediate portion of the nozzle cover 3, and has a cylindrical shape having a smaller diameter than the introduction-side channel proximal-side outer cylindrical wall 423. The introduction-side channel interior cylindrical wall 424 and the introduction-side channel proximal-side outer cylindrical wall 423 form a double pipe structure. The introduction-side channel interior cylindrical wall 424 opens toward the nozzle support 5. The inner peripheral surface of the introduction-side channel interior cylindrical wall 424 receives the distal end portion of the cleaning water introduction pipe 51 of the nozzle support 5 fitted thereon.

The flange 426 is formed at the proximal end of the introduction-side channel-forming component 42 and has the shape of an annular plate expanding outwardly in the radial direction of the nozzle cover 3. In a state where the nozzle cover 3 has the ejection-side channel-forming component 41 and the introduction-side channel-forming component 42 disposed therein, the flange 426 is in contact with the reference surface 381 formed at the rear end of the nozzle cover 3. In the present embodiment, the front surface of the flange 426 is bonded and fixed to the reference surface 381 formed at the rear end of the nozzle cover 3. As a result, in a state where the nozzle cover 3 has the ejection-side channel-forming component 41 and the introduction-side channel-forming component 42 disposed therein, the introduction-side channel-forming component 42 is fixed while being positioned with respect to the axial direction of the nozzle cover 3.

The flange 426 has, on a circumferentially upper portion of its surface facing the distal end, the circumferential-positioning projection 426*a* having a semi-circular shape and projecting toward the distal end. In the state where the nozzle cover 3 has the ejection-side channel-forming component 41 and the introduction-side channel-forming component 42 disposed therein, the circumferential-positioning projection 426*a* is engaged with the circumferential-positioning notch 382 of the nozzle cover 3. As a result, in the state where the nozzle cover 3 has the ejection-side channel-forming component 41 and the introduction-side channel-forming component 42 disposed therein, the introduction-side channel-forming component 42 is fixed while being circumferentially positioned with respect to the nozzle cover 3.

As shown in FIG. 5, the intra-nozzle introduction-side inner channel F21 and the intra-nozzle introduction-side outer channel F22 are formed in the introduction-side channel body 421. The intra-nozzle introduction-side inner channel F21 allows cleaning water, which has been introduced through the intra-support inner introduction channel F11 of the nozzle support 5, to pass mainly through a radially central space in the introduction-side channel body 421 and the connection pipe 43, and to enter an intra-nozzle ejection-side inner channel F31 of the ejection-side channel body 411.

The intra-nozzle introduction-side outer channel F22 allows cleaning water, which has been introduced through the intra-support outer introduction channel F12 of the nozzle support 5, to pass through a space located radially outward in the introduction-side channel body 421, and through the intra-nozzle gap channels Fb between the outer peripheral surface of the connection pipe 43 and the inner peripheral surface of the introduction-side channel distal-side cylindrical wall 422, and to enter an intra-nozzle ejection-side outer channel F32 of the ejection-side channel body 411.

The ejection-side channel-forming component 41 is disposed in the nozzle cover 3 and constitutes an axially distal end portion of the nozzle 2. The proximal end portion of the ejection-side channel-forming component 41 is connected to the distal end portion of the introduction-side channel-forming component 42. In a state where the nozzle cover 3 has the ejection-side channel-forming component 41 disposed therein, a gap S1 is formed between an end face 41*a* at the distal end of the ejection-side channel-forming component 41 and an inner surface 35*a* of the distal end closing plate 35 of the nozzle cover 3.

As shown in FIGS. 5 to 7, the ejection-side channel-forming component 41 has the ejection-side channel body 411, the first water-ejection protrusion 414 (water-ejection portion) having a protruding shape, the second water-ejection protrusion 415 (water-ejection portion) having a protruding shape, and the ejection-side engagement recess 417 (first engagement portion).

The ejection-side channel body 411 has a closed distal end, and has a cylindrical outer shape. The ejection-side channel body 411 has the ejection-side channel outer cylindrical wall 412 and an ejection-side channel inner cylindrical wall 413 disposed in the ejection-side channel outer cylindrical wall 412 in an axially intermediate portion of the nozzle cover 3.

The ejection-side channel outer cylindrical wall 412 has a substantially cylindrical shape, and extends in the axial direction of the nozzle cover 3. The ejection-side channel outer cylindrical wall 412 constitutes the outer shape of the ejection-side channel body 411, and opens toward the proximal end of the nozzle cover 3. The ejection-side channel outer cylindrical wall 412 receives, on the inner peripheral surface thereof, the introduction-side channel distal-side cylindrical wall 422 formed at the distal end of the introduction-side channel-forming component 42.

The ejection-side channel-forming component 41 and the introduction-side channel-forming component 42 are arranged to be adjustable in position in the axial direction, while overlapping with each other as viewed in a direction perpendicular to the axial direction of the nozzle cover 3. The O-ring 422*c* constitutes a water-tight structure functioning as a seal between the ejection-side channel-forming component 41 and the introduction-side channel-forming component 42, in the portion where the channel-forming components 41 and 42 overlap with each other as viewed in the direction perpendicular to the axial direction of the nozzle cover 3.

As shown in FIG. 5, a gap S3 is formed between the proximal end face of the ejection-side channel outer cylindrical wall 412 and the step end face 422*b* formed adjacent to the proximal end of the introduction-side channel distal-side cylindrical wall 422 of the introduction-side channel-forming component 42. The ejection-side channel outer cylindrical wall 412 has a step surface formed adjacent to the distal end and facing radially inward. A gap S4 is formed between this step surface and the distal end face of the introduction-side channel distal-side cylindrical wall 422 of the introduction-side channel-forming component 42.

As shown in FIGS. 5 to 7, the ejection-side channel inner cylindrical wall 413 is located inside the ejection-side channel outer cylindrical wall 412 disposed in an axially intermediate portion of the nozzle cover 3, and has a cylindrical shape with a smaller diameter than the ejection-side channel outer cylindrical wall 412. The ejection-side channel inner cylindrical wall 413 and the ejection-side channel outer cylindrical wall 412 form a double pipe structure. The ejection-side channel inner cylindrical wall 413 opens toward the proximal end of the nozzle cover 3. The inner peripheral surface of the ejection-side channel inner cylindrical wall 413 receives the distal end portion of the connection pipe 43 press-fitted thereon.

The positions of the connection pipe 43 and the introduction-side channel-forming component 42 are adjustable with respect to ejection-side channel-forming component 41 in the axial direction of the nozzle cover 3. The connection pipe 43 and the ejection-side channel-forming component 41 are arranged to be adjustable in position in the axial direction, while overlapping with each other as viewed in a direction perpendicular to the axial direction of the nozzle cover 3. The distal end portion of the connection pipe 43 is press-fitted onto the inner peripheral surface of the ejection-side channel inner cylindrical wall 413. The distal end portion of the connection pipe 43 constitutes a water-tight structure functioning as a seal between the connection pipe 43 and the ejection-side channel-forming component 41, in the portion where the connection pipe 43 and the ejection-side channel-forming component 41 overlap with each other as viewed in a direction perpendicular to the axial direction of the nozzle cover 3. As shown in FIG. 5, a gap S2 is formed between a step surface of the ejection-side channel inner cylindrical wall 413 adjacent to the distal end and the distal end face of the connection pipe 43.

As shown in FIGS. 5 to 7, the first water-ejection protrusion 414 and the second water-ejection protrusion 415 are aligned in the axial direction of the nozzle cover 3 on the upper surface of a distal end portion of the ejection-side channel body 411. The first water-ejection protrusion 414 and the second water-ejection protrusion 415 each have a shape of a circular column, and protrude upward from the upper surface of the distal end portion of the ejection-side channel body 411.

The first water-ejection protrusion 414 has the first water-ejection opening 414*a* (channel-side water ejection opening). The first water-ejection opening 414*a* is formed to coincide in position with the first through-hole 31 of the nozzle cover 3 in the axial direction of the nozzle cover 3, and communicates with the first through-hole 31 of the nozzle cover 3. The first water-ejection opening 414*a* is inclined with respect to the thickness direction of the first water-ejection protrusion 414 such that the outlet of the first water-ejection opening 414*a* is oriented toward the proximal end of the nozzle 2.

The second water-ejection protrusion 415 has the second water-ejection opening 415*a* (channel-side water ejection opening). The second water-ejection opening 415*a* is formed to coincide in position with the second through-hole 32 of the nozzle cover 3 in the axial direction of the nozzle cover 3, and communicates with the second through-hole 32 of the nozzle cover 3. The second water-ejection opening 415*a* is inclined with respect to the thickness direction of the second water-ejection protrusion 415 such that the outlet of the second water-ejection opening 415*a* is oriented toward the proximal end of the nozzle 2.

The configuration in which the first water-ejection opening 414*a* and the second water-ejection opening 415*a* are inclined such that their outlets are oriented toward the proximal end of the nozzle 2 causes the cleaning water that has flowed through the channel-forming member 4 to be ejected onto a target position.

In a state where the nozzle cover 3 has the channel-forming member 4 disposed therein, the first water-ejection protrusion 414 is fitted in the first through-hole 31 along the depth thereof. In a state where the nozzle cover 3 has the channel-forming member 4 disposed therein, the second water-ejection protrusion 415 is fitted in the second through-hole 32 along the depth thereof. The surface of the first water-ejection protrusion 414 and the surface of the second water-ejection protrusion 415 are substantially flush with the surface of the nozzle cover 3. The state indicated by the term "substantially flush" includes a state where the surface of the first water-ejection protrusion 414 and the surface of the second water-ejection protrusion 415 are not completely coplanar with the surface of the nozzle cover 3, in addition to a state where these surfaces are coplanar with each other. The state indicated by the term "substantially flush" includes a case where the surface of the first water-ejection protrusion 414 and the surface of the second water-ejection protrusion 415 are slightly below the surface of the nozzle cover 3. Thus, the first through-hole 31 of the nozzle cover 3 is blocked by the first water-ejection protrusion 414 and the second through-hole 32 of the nozzle cover 3 is blocked by the second water-ejection protrusion 415. The surface of the first water-ejection protrusion 414 and the surface of the second water-ejection protrusion 415 may be above the surface of the nozzle cover 3.

The ejection-side engagement recess 417 is formed on the lower surface of a lower portion of the ejection-side channel-forming component 41. The ejection-side engagement recess 417 is an upward recess formed on the lower surface of the ejection-side channel-forming component 41, and is formed as an arc-shaped groove having a predetermined width in the axial direction of the nozzle cover 3 and extending in a predetermined length in the circumferential direction of the nozzle cover 3. The ejection-side engagement recess 417 is an upward recess formed on the lower surface of the ejection-side channel-forming component 41, and extends in the predetermined length in the circumferential direction. The ejection-side engagement recess 417 is fixedly engaged with the distal-side engagement protrusion 427 of the distal-side extension 425 of the introduction-side channel-forming component 42. Thus, the ejection-side channel-forming component 41 and the introduction-side channel-forming component 42 are fixed in place to each other, while being mutually restricted in movement in the axial and circumferential directions of the nozzle cover 3.

As shown in FIG. 5, in a state where the nozzle cover 3 has the ejection-side channel-forming component 41 assembled thereto, the lower gap Sa is formed in a radial direction of the nozzle cover 3 (direction perpendicular to the axial direction), between a lower portion of the ejection-side channel-forming component 41 and the nozzle cover 3. The lower gap Sa is a space for allowing the first water-ejection protrusion 414 and the second water-ejection protrusion 415 to be fitted into the first through-hole 31 and the second through-hole 32, respectively. The lower gap Sa also serves as a space for allowing the distal-side engagement protrusion 427 of the distal-side extension 425 of the introduction-side channel-forming component 42 to be fixedly engaged with the ejection-side engagement recess 417 of the ejection-side channel-forming component 41.

In a state where the nozzle cover 3 has the ejection-side channel-forming component 41 assembled thereto, the introduction-side channel-forming component 42 is assembled to the nozzle cover 3, whereby the distal-side extension 425 of the introduction-side channel-forming component 42 becomes disposed in the lower gap Sa. The distal-side extension 425 of the introduction-side channel-forming component 42 is disposed in the lower gap Sa between the ejection-side channel-forming component 41 and the nozzle cover 3. The distal-side engagement protrusion 427 of the distal-side extension 425 of the introduction-side channel-forming component 42 is fixedly engaged with the ejection-side engagement recess 417 of the ejection-side channel-forming component 41. As a result, the ejection-side channel-forming component 41 and the introduction-side channel-forming component 42 are fixed in place to each other so as not be separated in the axial direction. Arranging the distal-side extension 425 in the lower gap Sa enables the ejection-side channel-forming component 41 to be supported from below, whereby the positioning of the ejection-side channel-forming component 41 can be performed in the radial direction of the nozzle cover 3.

As shown in FIG. 5, the ejection-side channel body 411 has therein the intra-nozzle ejection-side inner channel F31 and the intra-nozzle ejection-side outer channel F32. The intra-nozzle ejection-side inner channel F31 allows cleaning water, which has flowed through the connection pipe 43 connected to the ejection-side channel inner cylindrical wall 413 of the ejection-side channel body 411, to pass mainly through a radially central portion of the ejection-side channel body 411, and to reach the first water-ejection opening 414*a* of the first water-ejection protrusion 414.

The intra-nozzle ejection-side outer channel F32 allows cleaning water, which has flowed through the introduction-side channel-forming component 42 connected to the ejection-side channel outer cylindrical wall 412 at the proximal end of the ejection-side channel body 411, to pass mainly through a radially outer portion of the ejection-side channel body 411, and to reach the second water-ejection opening 415*a* of the second water-ejection protrusion 415.

Figure 8A:
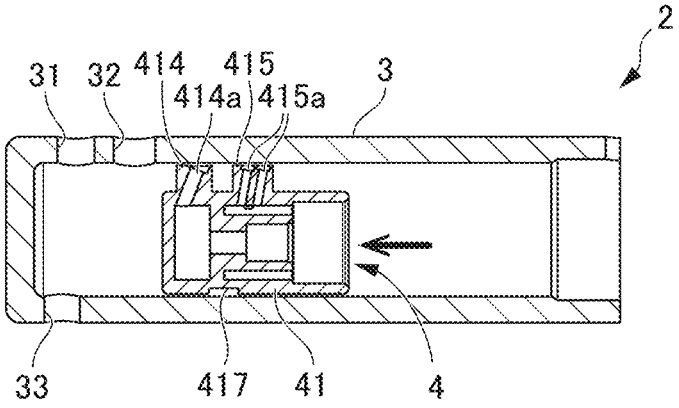
FIG. 8A is a diagram showing a step of a process of assembling the nozzle, in which an ejection-side channel-forming component is being inserted into a nozzle cover.

Next, a process for assembling the nozzle 2 will be described. As shown in FIG. 8A, to assemble the nozzle 2, the ejection-side channel-forming component 41 of the channel-forming member 4 is inserted into the nozzle cover 3 through the open end of the nozzle cover 3. The ejection-side channel-forming component 41 is then moved toward the axially distal end until the ejection-side channel-forming component 41 reaches a location at which the first water-ejection protrusion 414 and the second water-ejection protrusion 415 are ready to be fitted into the first though-hole 31 and the second through-hole 32, respectively.

Figure 8B:
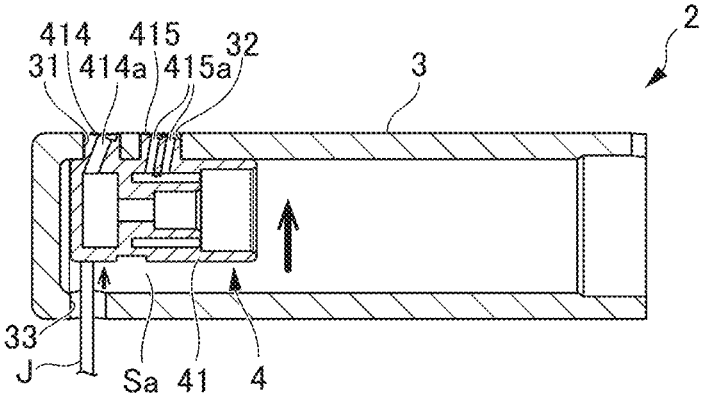
FIG. 8B is a diagram showing a step of the process of assembling the nozzle, in which the ejection-side channel-forming component has been moved to be disposed adjacent to an upper side.

As shown in FIG. 8B, in the state where the ejection-side channel-forming component 41 has been assembled to the nozzle cover 3, the lower gap Sa is formed in the radial direction of the nozzle cover 3, between the lower portion of the ejection-side channel-forming component 41 and the nozzle cover 3. The lower gap Sa is the space for allowing the first water-ejection protrusion 414 and the second water-ejection protrusion 415 to be fitted into the first through-hole 31 and the second through-hole 32, respectively. The lower gap Sa also serves as the space for allowing the distal-side engagement protrusion 427 of the distal-side extension 425 of the introduction-side channel-forming component 42 to be fixedly engaged with the ejection-side engagement recess 417 of the ejection-side channel-forming component 41.

As shown in FIG. 8B, a rod-shaped jig J is then inserted through the lower surface opening 33 of the nozzle cover 3 to move the ejection-side channel-forming component 41 upwardly, so that the first water-ejection protrusion 414 and the second water-ejection protrusion 415 are fitted into the first though-hole 31 and the second through-hole 32, respectively. Note that this is a non-limiting example. It is conceivable that a jig is inserted through the open end of the nozzle cover 3 to move the ejection-side channel-forming component 41 upwardly, so that the first water-ejection protrusion 414 and the second water-ejection protrusion 415 are fitted into the first though-hole 31 and the second through-hole 32, respectively. Fitting the first water-ejection protrusion 414 into the first though-hole 31 and the second water-ejection protrusion 415 into the second through-hole 32 results in the positioning of the ejection-side channel-forming component 41 with respect to the nozzle cover 3.

Since the first water-ejection protrusion 414 and the second water-ejection protrusion 415 are fitted in the first though-hole 31 and the second through-hole 32, the first though-hole 31 and the second through-hole 32 of the nozzle cover 3 are less likely to become dirty in the depth direction. As a result, maintenance operation can be reduced.

The first water-ejection protrusion 414 and the second water-ejection protrusion 415 are arranged such that their surfaces are not below the surface of the nozzle cover 3. That is, the first though-hole 31 and the second through-hole 32 of the nozzle cover 3 are blocked by the first water-ejection protrusion 414 and the second water-ejection protrusion 415, respectively. Thus, the first though-hole 31 and the second through-hole 32 do not form any recessed portion on the surface of the nozzle cover 3, making it less likely for dirt to accumulate in the first though-hole 31 and the second through-hole 32.

Figure 8C:
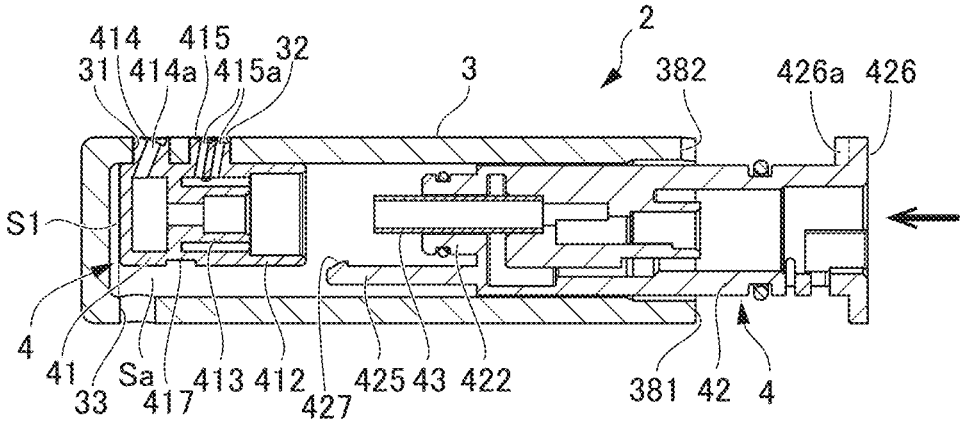
FIG. 8C is a diagram showing a step of the process of assembling the nozzle, in which an introduction-side channel-forming component is being inserted into the nozzle cover.
Figure 8D:
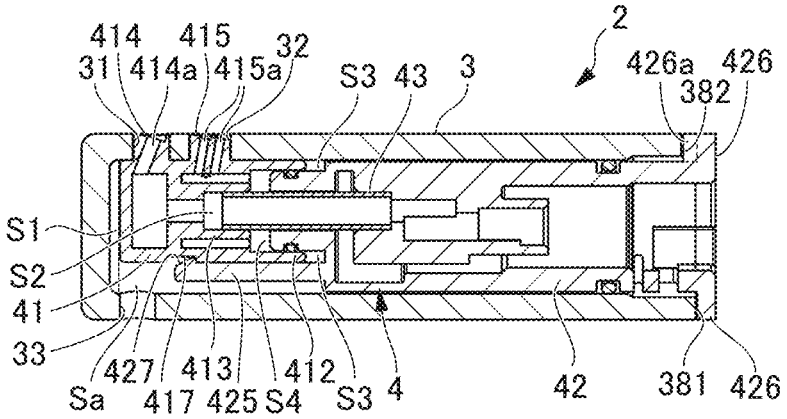
FIG. 8D is a diagram showing a step of the process of assembling the nozzle, in which the ejection side channel-forming component and the introduction-side channel-forming component have been inserted into the nozzle cover.

Next, as shown in FIG. 8C, the introduction-side channel-forming component 42 having the connection pipe 43 attached to the distal end thereof is inserted through the open end of the nozzle cover 3. Thereafter, as shown in FIG. 8D, the distal end portion of the connection pipe 43 is press-fitted into the ejection-side channel inner cylindrical wall 413 of the ejection-side channel-forming component 41, and at the same time, the introduction-side channel distal-side cylindrical wall 422 of the introduction-side channel-forming component 42 is inserted into the ejection-side channel outer cylindrical wall 412 of the ejection-side channel-forming component 41.

The distal-side extension 425 of the introduction-side channel-forming component 42 becomes disposed in the lower gap Sa between the ejection-side channel-forming component 41 and the nozzle cover 3. The distal-side engagement protrusion 427 of the distal-side extension 425 of the introduction-side channel-forming component 42 is fixedly engaged with the ejection-side engagement recess 417 of the ejection-side channel-forming component 41. As a result, the ejection-side channel-forming component 41 and the introduction-side channel-forming component 42 are fixed in place to each other so as not to be separated in the axial direction. Arranging the distal-side extension 425 in the lower gap Sa enables the ejection-side channel-forming component 41 to be supported from below, whereby the positioning of the ejection-side channel-forming component 41 can be performed in the radial direction of the nozzle cover 3.

At the rear end of the introduction-side channel-forming component 42, the circumferential-positioning projection 426*a* provided at an upper portion of the flange 426 of the introduction-side channel-forming component 42 has been engaged with the circumferential-positioning notch 382 of the nozzle cover 3. In this state, the positioning of the flange 426 of the introduction-side channel-forming component 42 in the axial direction of the nozzle cover 3 is performed at the reference surface 381 formed at the rear end of the nozzle cover 3, and the flange 426 is strongly fixed to the nozzle cover 3 by bonding.

In the nozzle 2 configured as described above, the ejection-side channel-forming component 41 is fixed in place to the introduction-side channel-forming component 42 so that the channel-forming components 41 and 42 are integrated with each other so as not to be separated from each other in the axial direction. Thus, the introduction-side channel-forming component 42 can be stably fixed to the ejection-side channel-forming component 41. As a result, the channel-forming member 4 can be stably fixed in the nozzle cover 3.

To remove the channel-forming member 4 from the nozzle cover 3, the introduction-side channel-forming component 42 is pulled out through the open end of the nozzle cover 3 in the axial direction. In this way, the channel-forming member 4 composed of the ejection-side channel-forming component 41 and the introduction-side channel-forming component 42, which are integrated with each other so as not to be separated in the axial direction, can be easily removed from the nozzle cover 3.

According to the present embodiment, the ejection-side channel-forming component 41 and the introduction-side channel-forming component 42 are fixed in place, while being mutually restricted in movement in the axial and circumferential directions of the nozzle cover 3. This feature enables easy positioning of the introduction-side channel-forming component 42 with respect to the ejection-side channel-forming component 41 in the axial and circumferential directions, such that the ejection-side channel-forming component 41 and the introduction-side channel-forming component 42 are prevented from displacing in the axial and circumferential directions.

According to the present embodiment, in a state where the nozzle cover 3 has the ejection-side channel-forming component 41 assembled thereto, the lower gap Sa is formed between the ejection-side channel-forming component 41 and the nozzle cover 3. The lower gap Sa is the space for allowing the first water-ejection protrusion 414 and the second water-ejection protrusion 415 to be fitted into the first through-hole 31 and the second through-hole 32, respectively. Thus, since the lower gap Sa can be utilized to move the ejection-side channel-forming component 41, the first water-ejection protrusion 414 and the second water-ejection protrusion 415 can be easily fitted into the first through-hole 31 and the second through-hole 32, respectively. This makes it easy to assemble the nozzle 2.

The lower gap Sa also serves as the space for allowing the distal-side engagement protrusion 427 of the distal-side extension 425 of the introduction-side channel-forming component 42 to be fixedly engaged with the ejection-side engagement recess 417 of the ejection-side channel-forming component 41. Thus, arranging the distal-side extension 425 of the introduction-side channel-forming component 42 in the lower gap Sa makes it easy to fixedly engage the distal-side engagement protrusion 427 of the distal-side extension 425 of the introduction-side channel-forming component 42 with the ejection-side engagement recess 417 of the ejection-side channel-forming component 41. This simple structure to fixedly engage the distal-side engagement protrusion 427 of the introduction-side channel-forming component 42 with the ejection-side engagement recess 417 of the ejection-side channel-forming component 41 enables the ejection-side channel-forming component 41 and the introduction-side channel-forming component 42 to be fixed in place to each other in the nozzle cover 3 so as not to be separated from each other in the axial direction. This feature makes it easy to assemble the nozzle 2.

The introduction-side channel-forming component 42 is configured to contribute to the positioning of the ejection-side channel-forming component 41 in such a manner that the distal-side extension 425 of the introduction-side channel-forming component 42 is arranged in the lower gap Sa. This feature makes it less likely for the ejection-side channel-forming component 41 to be displaced in the radial direction of the nozzle cover 3, and can maintain the first and second water-ejection protrusions 414 and 415 fitted in the first and second through-holes 31 and 32, respectively.

According to the present embodiment, the introduction-side channel-forming component 42 is fixed to the nozzle cover 3 by bonding and/or press-fitting. Thus, the ejection-side channel-forming component 41 and the introduction-side channel-forming component 42 can be strongly fixed to the nozzle cover 3.

The above-described nozzle 2 of the present embodiment provides the following advantages. The nozzle 2 of the present embodiment includes: the nozzle cover 3 made of ceramic and having the second though-hole 32; the ejection-side channel-forming component 41 disposed in the nozzle cover 3 and having the second water-ejection opening 415*a* which communicates with the second though-hole 32; and the rear-side channel-forming components (introduction-side channel-forming component 42, the connection pipe 43) connected to a rear portion of the ejection-side channel-forming component 41 in the axial direction of the nozzle cover 3, and capable of being adjusted in the axial direction of the nozzle cover 3 with respect to the ejection-side channel-forming component 41.

With this configuration, even though the nozzle cover 3 is made of ceramic and even if the nozzle cover 3 has a dimensional deviation in the axial direction caused by the manufacturing process, the dimensional deviation in the axial direction is canceled out and the positioning of the channel-forming member 4 can be easily performed. Further, even if the ejection-side channel-forming component 41 and the introduction-side channel-forming component 42 have a dimensional deviation in the axial direction caused by the manufacturing process, the dimensional deviation in the axial direction is canceled out and the positioning of the channel-forming member 4 can be easily performed. This feature makes it easy to assemble the nozzle 2.

According to the present embodiment, the nozzle cover 3 has therein the gaps S1, S2, S3, and S4 which enable the ejection-side channel-forming component 41, the introduction-side channel-forming component 42, and the connection pipe 43 to be adjusted in position in the axial direction of the nozzle cover 3. With this configuration, even if the nozzle cover 3, the ejection-side channel-forming component 41, the introduction-side channel-forming component 42, and the connection pipe 43 have a dimensional deviation in the axial direction caused by the manufacturing process, the dimensional deviation in the axial direction is canceled out and the positioning of the channel-forming member 4 can be easily performed in the axial direction. This feature makes it easy to assemble the nozzle 2.

According to the present embodiment, a water-tight structure functioning as a seal between the ejection-side channel-forming component 41 and the introduction-side channel-forming component 42 is provided in a portion where the channel-forming components 41 and 42 overlap with each other as viewed in a direction perpendicular to the axial direction of the nozzle cover 3. Further, a water-tight structure functioning as a seal between the ejection-side channel-forming component 41 and the connection pipe 43 is provided in a portion where the ejection-side channel-forming component 41 and the connection pipe 43 overlap with each other as viewed in a direction perpendicular to the axial direction of the nozzle cover 3. Thus, even though the channel-forming member 4 is composed of two or more components, leakage of water is prevented in each portion where the ejection-side channel-forming component 41, the introduction-side channel-forming component 42, and the connection pipe 43 respectively overlap with each other. Consequently, it is ensured that the channel-forming member 4 fulfills the function as the channel of cleaning water.

According to the present embodiment, the positioning of the ejection-side channel-forming component 41 is performed with respect to the nozzle cover 3. This feature facilitates the positioning of the ejection-side channel-forming component 41 in the axial direction of the nozzle cover 3.

According to the present embodiment, the ejection-side channel-forming component 41 has the first water-ejection protrusion 414 having a protruding shape and provided with the first water-ejection opening 414*a*, and the second water-ejection protrusion 415 having a protruding shape and provided with the second water-ejection opening 415*a*. The first water-ejection protrusion 414 is fitted in the first through-hole 31 of the nozzle cover 3 while the second water-ejection protrusion 415 is fitted in the second through-hole 32 of the nozzle cover 3. This feature facilitates the positioning of the ejection-side channel-forming component 41 in the axial direction of the nozzle cover 3.

According to the present embodiment, the positioning of the introduction-side channel-forming component 42 is performed in the axial direction of the nozzle cover 3 at the reference surface 381 formed in the rear portion the nozzle cover 3. Thus, in a state where the positioning of the introduction-side channel-forming component 42 has been performed in the axial direction at the reference surface 381, the ejection-side channel-forming component 41, the introduction-side channel-forming component 42, and the connection pipe 43 are arranged in the nozzle cover 3 such that their positions in the axial direction can be adjusted. As a result, the positioning of the ejection-side channel-forming component 41, the introduction-side channel-forming component 42, and the connection pipe 43 can easily performed in the axial direction of the nozzle cover 3.

According to the present embodiment, the introduction-side channel-forming component 42 is fixed to the nozzle cover 3. Thus, since the introduction-side channel-forming component 42 is fixed while having been positioned in the axial direction of the nozzle cover 3, the ejection-side channel-forming component 41, the introduction-side channel-forming component 42, and the connection pipe 43 can be fixed while having been positioned in the axial direction of the nozzle cover 3.

According to the present embodiment, in a state where the nozzle cover 3 has the ejection-side channel-forming component 41 assembled thereto, the lower gap Sa is formed between the ejection-side channel-forming component 41 and the nozzle cover 3. The lower gap Sa is the space for allowing the first water-ejection protrusion 414 and the second water-ejection protrusion 415 to be fitted into the first through-hole 31 and the second through-hole 32, respectively. Thus, since the lower gap Sa can be utilized to move the ejection-side channel-forming component 41, the first water-ejection protrusion 414 and the second water-ejection protrusion 415 can be easily fitted into the first through-hole 31 and the second through-hole 32, respectively. This makes it easy to assemble the nozzle 2.

According to the present embodiment, the introduction-side channel-forming component 42 is fixed in place to the ejection-side channel-forming component 41. Thus, the ejection-side channel-forming component 41 and the introduction-side channel-forming component 42 are integrated with each other so as not to be separated in the axial direction, whereby the introduction-side channel-forming component 42 can be stably fixed to the ejection-side channel-forming component 41. As a result, the channel-forming member 4 can be stably fixed in the nozzle cover 3. To remove the channel-forming member 4 from the nozzle cover 3, the introduction-side channel-forming component 42 is pulled out through the open end of the nozzle cover 3 in the axial direction. In this way, the channel-forming member 4 composed of the ejection-side channel-forming component 41 and the introduction-side channel-forming component 42, which are integrated with each other so as not to be separates in the axial direction, can be easily removed from the nozzle cover 3.

Next, a nozzle 2A of a second embodiment will be described. In the following description of the second embodiment, components and elements that are the same or similar to those of the first embodiment are denoted by the same or similar reference characters, and description of such components and elements will be simplified or omitted. The second embodiment differs in the number of channels from the first embodiment. Specifically, while the first embodiment has two channels, the second embodiment has one channel. The nozzle 2A of the second embodiment differs from the nozzle 2 of the first embodiment in that a channel-forming member 4A of the second embodiment includes an ejection-side channel-forming component 45 and an introduction-side channel-forming component 46.

Figure 9:
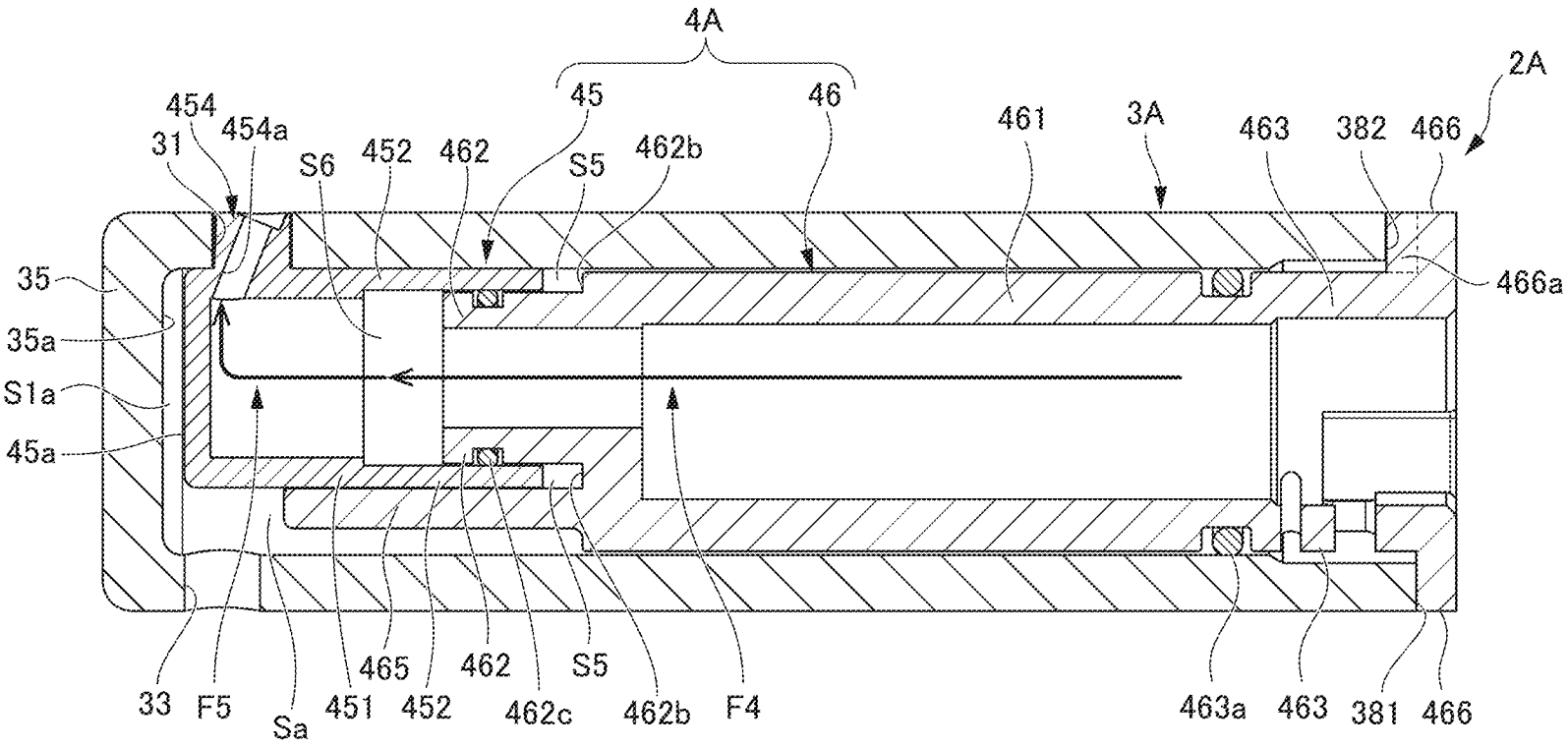
FIG. 9 is a diagram showing a nozzle of a second embodiment.
Figure 10:
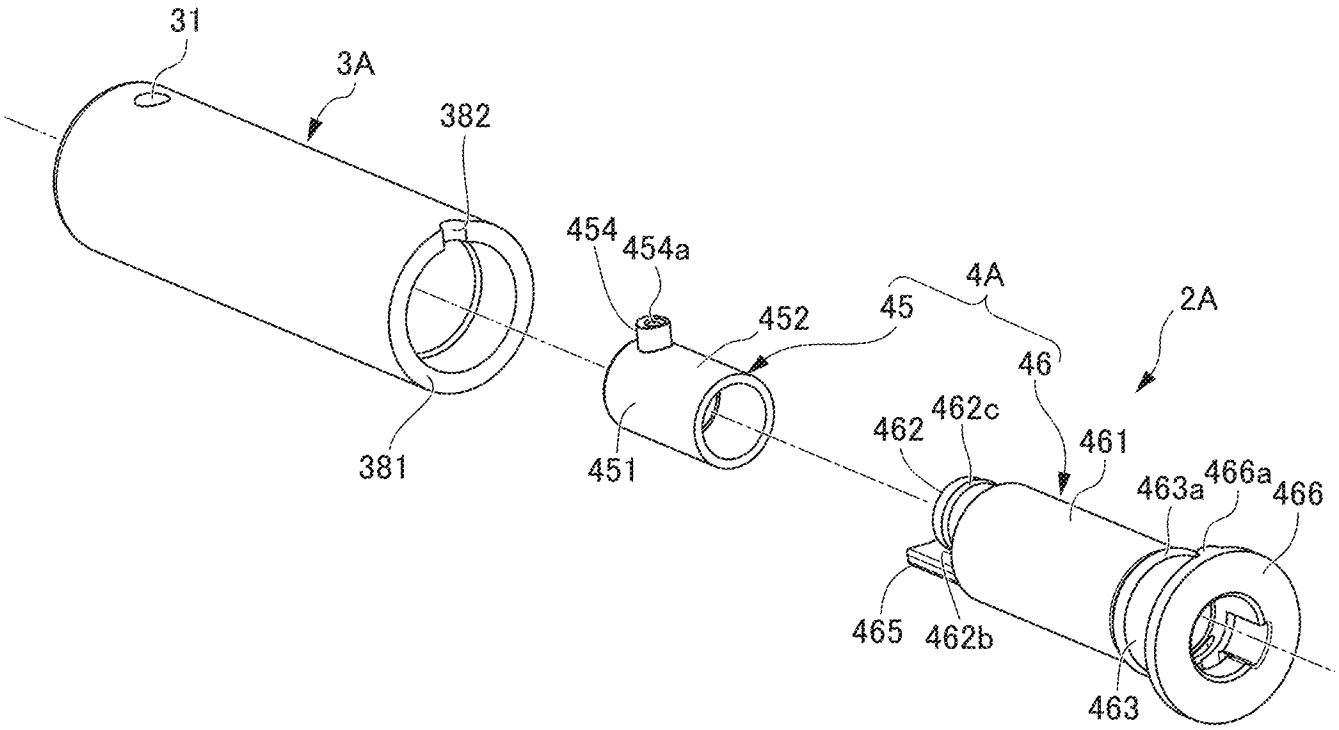
FIG. 10 is an exploded perspective view of the nozzle of the second embodiment, as viewed obliquely from above.

As shown in FIGS. 9 and 10, the nozzle 2A includes a cylindrical nozzle cover 3A and the channel-forming member 4A disposed in the nozzle cover 3A. The channel-forming member 4A has the ejection-side channel-forming component 45 (distal-side channel-forming component, first channel-forming component) and the introduction-side channel-forming component 46 (rear-side channel-forming component, second channel-forming component). The nozzle cover 3A has, on its upper surface near the distal end, a first through-hole 31. The first through-hole 31 receives a first water-ejection protrusion 454 (to be described later) fitted therein, the first water-ejection protrusion 454 being provided on the ejection-side channel-forming component 45 of the channel-forming member 4A disposed in the nozzle cover 3A.

The ejection-side channel-forming component 45 and the introduction-side channel-forming component 46 are disposed in the nozzle cover 3A. The ejection-side channel-forming component 45 and the introduction-side channel-forming component 46 are aligned in the axial direction of the nozzle cover 3A. In the nozzle cover 3A, the ejection-side channel-forming component 45 is disposed adjacent to the axially distal end and the upper side of the nozzle 2A. In the nozzle cover 3A, the introduction-side channel-forming component 46 is disposed adjacent to the axially proximal end of the nozzle cover 3A.

The introduction-side channel-forming component 46 is fixed to a reference surface 381 of the nozzle cover 3A by bonding and/or press-fitting. A distal end portion of the introduction-side channel-forming component 46 is fixed in place to a proximal end portion (rear portion) of the ejection-side channel-forming component 45.

The introduction-side channel-forming component 46 has an introduction-side channel body 461, a distal-side extension 465 (gap-insertion portion) extending toward the distal end from a lower portion of a distal end of the introduction-side channel body 461, and a flange 466 formed in a proximal end portion of the introduction-side channel body 461. In a state where the distal end portion of the introduction-side channel-forming component 46 is connected to the proximal end portion of the ejection-side channel-forming component 45, the distal-side extension 465 is disposed in a lower gap Sa (engagement gap, fitting gap) between a lower portion of the ejection-side channel-forming component 45 (to be described later) and the nozzle cover 3A.

The introduction-side channel body 461 has a cylindrical outer shape. The introduction-side channel body 461 has an introduction-side channel distal-side cylindrical wall 462 formed adjacent to the distal end, and an introduction-side channel proximal-side outer cylindrical wall 463 formed adjacent to the proximal end.

The introduction-side channel distal-side cylindrical wall 462 is formed at an end of the introduction-side channel body 461, the end being located adjacent to the distal end of the nozzle cover 3A. The introduction-side channel distal-side cylindrical wall 462 has a cylindrical shape the outer peripheral surface of which is smaller in diameter than the outer peripheral surface of the introduction-side channel body 461 by the height of a step formed. The introduction-side channel distal-side cylindrical wall 462 extends from the outer peripheral surface of the introduction-side channel body 461 with a step end face 462*b* interposed therebetween, and extends cylindrically toward the distal end from a point located inside with respect to the outer peripheral surface of the introduction-side channel body 461 by the height of the step.

The introduction-side channel distal-side cylindrical wall 462 opens toward the ejection-side channel-forming component 45 (to be described later). An O-ring 462*c* is attached to the outer peripheral surface of the introduction-side channel distal-side cylindrical wall 462. To connect the introduction-side channel-forming component 46 to the ejection-side channel-forming component 45, the outer peripheral surface of the introduction-side channel distal-side cylindrical wall 462 is fitted to an ejection-side channel outer cylindrical wall 452 of an ejection-side channel body 451.

The introduction-side channel proximal-side outer cylindrical wall 463 is formed at an end of the introduction-side channel body 461, the end being located adjacent to the proximal end of the nozzle cover 3A. The introduction-side channel proximal-side outer cylindrical wall 463 opens toward a nozzle support (not shown). The nozzle support of the second embodiment supplies cleaning water to the nozzle 2A through one channel, whereas the nozzle support 5 of the first embodiment supplies cleaning water to the nozzle 2 through two channels.

To connect the introduction-side channel-forming component 46 to the nozzle support (not shown), a distal end portion of the nozzle support is fitted on the inner peripheral surface of the introduction-side channel proximal-side outer cylindrical wall 463. An O-ring 463*a* is attached to the outer peripheral surface of the introduction-side channel proximal-side outer cylindrical wall 463.

As shown in FIG. 9, an intra-nozzle introduction channel F4 is formed in the introduction-side channel body 461. The intra-nozzle introduction channel F4 allows cleaning water, which has been introduced from the nozzle support (not shown), to flow to an intra-nozzle ejection-side inner channel F5 of the ejection-side channel body 451.

The ejection-side channel-forming component 45 is disposed in the nozzle cover 3A and constitutes an axially distal end portion of the nozzle 2A. The proximal end portion of the ejection-side channel-forming component 45 is connected to the distal end portion of the introduction-side channel-forming component 46. In a state where the nozzle cover 3A has the ejection-side channel-forming component 45 disposed therein, a gap S1a is formed between an end face 45*a* at the distal end of the ejection-side channel-forming component 45 and an inner surface 35*a* of a distal end closing plate 35 of the nozzle cover 3A.

As shown in FIGS. 9 and 10, the ejection-side channel-forming component 45 has the ejection-side channel body 451 and a first water-ejection protrusion 454 (water-ejection portion) having a protruding shape. The ejection-side channel body 451 has a closed distal end, and has a cylindrical outer shape. The ejection-side channel body 451 has the ejection-side channel outer cylindrical wall 452.

The ejection-side channel outer cylindrical wall 452 has a substantially cylindrical shape, and extends in the axial direction of the nozzle cover 3A. The ejection-side channel outer cylindrical wall 452 constitutes the outer shape of the ejection-side channel body 451, and opens toward the proximal end of the nozzle cover 3A. The ejection-side channel outer cylindrical wall 452 receives, on the inner peripheral surface thereof, the introduction-side channel distal-side cylindrical wall 462 provided at the distal end of the introduction-side channel-forming component 46.

The ejection-side channel-forming component 45 and the introduction-side channel-forming component 46 are arranged to be adjustable in position in the axial direction, while overlapping with each other as viewed in a direction perpendicular to the axial direction of the nozzle cover 3A. The O-ring 462*c* constitutes a water-tight structure functioning as a seal between the ejection-side channel-forming component 45 and the introduction-side channel-forming component 46, in the portion where the channel-forming components 45 and 46 overlap with each other as viewed in the direction perpendicular to the axial direction of the nozzle cover 3A.

As shown in FIG. 9, a gap S5 is formed between the proximal end face of the ejection-side channel outer cylindrical wall 452 and the step end face 462*b* formed adjacent to the proximal end of the introduction-side channel distal-side cylindrical wall 462 of the introduction-side channel-forming component 46. The ejection-side channel outer cylindrical wall 452 has a step surface formed adjacent to the distal end and facing radially inward. A gap S6 is formed between the step surface and a distal end face of the introduction-side channel distal-side cylindrical wall 462 of the introduction-side channel-forming component 46.

The first water-ejection protrusion 454 is disposed on the upper surface of a distal end portion of the ejection-side channel body 451. The first water-ejection protrusion 454 has the shape of a circular column, and protrudes upward from the upper surface of the distal end portion of the ejection-side channel body 451.

The first water-ejection protrusion 454 has a first water-ejection opening 454*a* (channel-side water-ejection opening). The first water-ejection opening 454*a* is formed to coincide in position with the first through-hole 31 of the nozzle cover 3A in the axial direction of the nozzle cover 3A, and communicates with the first through-hole 31 of the nozzle cover 3A. The first water-ejection opening 454*a* is inclined with respect to the thickness direction of the first water-ejection protrusion 454 such that the outlet of the first water-ejection opening 454*a* is oriented toward the proximal end of the nozzle 2A.

The configuration in which the first water-ejection opening 454*a* is inclined so that the outlet thereof is oriented toward the proximal end of the nozzle 2A causes the cleaning water that has flowed through the channel-forming member 4A to be ejected onto a target position.

In a state where the nozzle cover 3A has the channel-forming member 4A disposed therein, the first water-ejection protrusion 454 is fitted in the first through-hole 31 along the depth thereof. The surface of the first water-ejection protrusion 454 is substantially flush with the surface of the nozzle cover 3A. The state indicated by the term "substantially flush" includes a state where the surface of the first water-ejection protrusion 454 is not completely coplanar with the surface of the nozzle cover 3A, in addition to a state where these surfaces are coplanar with each other. The state indicated by the term "substantially flush" includes a case the surface of the first water-ejection protrusion 454 is slightly below the surface of the nozzle cover 3A. Thus, the first through-hole 31 of the nozzle cover 3A is blocked by the first water-ejection protrusion 454. The surface of the first water-ejection protrusion 454 may be above the surface of the nozzle cover 3A.

As shown in FIG. 9, in a state where the nozzle cover 3A has the ejection-side channel-forming component 45 assembled thereto, the introduction-side channel-forming component 46 is assembled to the nozzle cover 3A, whereby the distal-side extension 465 of the introduction-side channel-forming component 46 becomes disposed in the lower gap Sa. Arranging the distal-side extension 465 in the lower gap Sa enables the ejection-side channel-forming component 45 to be supported from below in a radial direction of the nozzle cover 3A, whereby the positioning of the ejection-side channel-forming component 45 can be performed.

As shown in FIG. 9, the ejection-side channel body 451 has therein the intra-nozzle ejection-side inner channel F5. The intra-nozzle ejection-side inner channel F5 allows cleaning water, which has flowed through the interior of the ejection-side channel inner cylindrical wall 453 of the ejection-side channel body 451, to pass mainly through a radially central portion of the ejection-side channel body 451, and to reach the first water-ejection opening 454*a* of the first water-ejection protrusion 454.

To assemble the nozzle 2A, the ejection-side channel-forming component 45 of the channel-forming member 4A is inserted into the nozzle cover 3A through the open end of the nozzle cover 3A. The ejection-side channel-forming component 45 is then moved toward the axially distal end until the ejection-side channel-forming component 45 reaches a location at which the first water-ejection protrusion 454 is ready to be fitted into the first though-hole 31. Thereafter, the ejection-side channel-forming component 45 is moved upward to fit the first water-ejection protrusion 454 into the first though-hole 31.

Next, the introduction-side channel-forming component 46 is inserted through the open end of the nozzle cover 3A. Subsequently, the introduction-side channel distal-side cylindrical wall 462 of the introduction-side channel-forming component 46 is inserted into the ejection-side channel outer cylindrical wall 452 of the ejection-side channel-forming component 45.

The rear end of the introduction-side channel-forming component 46 is fixed to the nozzle cover 3A. For example, according to the present embodiment, the front surface of the flange 466 of the introduction-side channel-forming component 46 is positioned at a reference surface 381 formed at the rear end of the nozzle cover 3A in the axial direction of the nozzle cover 3A, and fixed to the nozzle cover 3A by bonding. In another embodiment, the fixing may be achieved by press-fitting.

The above-described nozzle 2A of the second embodiment provides the following advantages. In the nozzle 2A of the present embodiment, the ejection-side channel-forming component 45 and the introduction-side channel-forming component 46 are arranged to be adjustable in position in the axial direction of the nozzle cover 3A, while at least a portion of the ejection-side channel-forming component 45 overlays on at least a portion of the introduction-side channel-forming component 46 as viewed in a direction perpendicular to the axial direction of the nozzle cover 3A. Thus, even if the nozzle cover 3A is made of ceramic and the nozzle cover 3A has a dimensional deviation in the axial direction caused by the manufacturing process, the dimensional deviation in the axial direction is canceled out and the positioning of the channel-forming member 4A in the axial direction can be easily performed. Further, even if the ejection-side channel-forming component 45 and the introduction-side channel-forming component 46 have a dimensional deviation in the axial direction caused by the manufacturing process, the dimensional deviation in the axial direction is canceled out and the positioning of the channel-forming member 4A in the axial direction can be easily performed. This feature makes it easy to assemble the nozzle 2A.

According to the present embodiment, the nozzle cover 3A has therein the gaps S5 and S6 which enable the ejection-side channel-forming component 45 and the introduction-side channel-forming component 46 to be adjusted in position in the axial direction of the nozzle cover 3A. With this configuration, even if the nozzle cover 3A, the ejection-side channel-forming component 45, and the introduction-side channel-forming component 46 have a dimensional deviation in the axial dimension caused by the manufacturing process, the dimensional deviation in the axial direction is canceled out and the positioning of the channel-forming member 4A in the axial direction can be easily performed.

Some embodiments of the present disclosure have been described in the foregoing. Note that the present disclosure is not limited to the embodiments described above, and modifications can be made as appropriate.

For example, in the first embodiment, the channel-forming member 4 is composed of the three channel-forming components (the ejection-side channel-forming component 41, the introduction-side channel-forming component 42, and the connection pipe 43). In the second embodiment, the channel-forming member 4A is composed of the two channel-forming components (the ejection-side channel-forming component 45 and the introduction-side channel-forming component 46). However, these are non-limiting examples, and the channel-forming member may be composed of four or more channel-forming components. The channel-forming member 4 may exclude the connection pipe 43.

In the above embodiment, the ejection-side channel-forming component 41 is embodied as a single component. However, this is a non-limiting example. The ejection-side channel-forming component 41 may be composed of two or more components.

In the above embodiments, the channel-forming member 4, 4A includes therein a plurality of channels F11, F12, F21, F22, F31, F32, F4, and F5. However, the position where the channels pass and the number of the channels are not limited to those of the embodiments described above.

The first embodiment described above includes two water-ejection portions having a protruding shape (the first water-ejection protrusion 414, the second water-ejection protrusion 415) and two water ejection openings (the first through-hole 31, the second through-hole 32). The second embodiment described above includes one water-ejection portion having a protruding shape (the first water-ejection protrusion 454) and one water ejection opening (the first through-hole 31). However, these are non-limiting examples. For example, it is conceivable to provide three or more water-ejection portions having a protruding shape and three or more water ejection openings.

Unlike the embodiment described above, the surface of the first water-ejection protrusion 414 and the surface of the second water-ejection protrusion 415 may be below the surface of the nozzle cover 3.

EXPLANATION OF REFERENCE NUMERALS

1: Sanitary Cleaning Device
2: Nozzle
3: Nozzle Cover
4: Channel-Forming Member
31: First Through-Hole (Nozzle Cover-Side Water Ejection Opening)
32: Second Through-Hole (Nozzle Cover-Side Water Ejection Opening)
41: Ejection-Side Channel-Forming Component (Distal-Side Channel-Forming Component)
42: Introduction-Side Channel-Forming Component (Rear-Side Channel-Forming Component)
43: Connection Pipe (Rear-Side Channel-Forming Component)
45: Ejection-Side Channel-Forming Component (Distal-Side Channel-Forming Component)
46: Introduction-Side Channel-Forming Component (Rear-Side Channel-Forming Component)
381: Reference Surface (Reference Position)
414, 454: First Water-Ejection Protrusion (Water-Ejection Portion)
414*a*, 454*a*: First Water-Ejection Opening (Channel-Side Water Ejection Opening)
415: Second Water-Ejection Protrusion (Water-Ejection Portion)
415*a*: Second Water-Ejection Opening (Channel-Side Water Ejection Opening)
S1, S2, S3, S4, S5, S6: Gap

What is claimed is:

1. A nozzle for a sanitary cleaning device, the nozzle comprising:

a nozzle cover made of ceramic and having a nozzle cover-side water ejection opening, the nozzle cover-side water ejection opening being formed in a portion of an outer peripheral surface of the nozzle cover near a distal end, the outer peripheral surface extending in an axial direction, the portion of the outer peripheral surface facing upward from the sanitary cleaning device;

a distal-side channel-forming component disposed in the nozzle cover and having a channel-side water ejection opening which communicates with the nozzle cover-side water ejection opening;

a rear-side channel-forming component connected to a rear portion of the distal-side channel-forming component in the axial direction of the nozzle cover, and capable of being adjusted in position in the axial direction of the nozzle cover with respect to the distal-side channel-forming component; and a water-tight structure functioning as a seal between the distal-side channel-forming component and the rear-side channel-forming component such that the nozzle cover is able to be adjusted in position in the axial direction.

2. The nozzle of claim 1, wherein the nozzle cover has therein a gap which enables the distal-side channel-forming component and the rear-side channel-forming component to be adjusted in position in the axial direction of the nozzle cover.

3. The nozzle of claim 1, wherein:

the water-tight structure functioning as the seal between the distal-side channel-forming component and the rear-side channel-forming component is provided in a portion where the distal-side channel-forming component and the rear-side channel-forming component overlap with each other as viewed in a direction perpendicular to the axial direction of the nozzle cover.

4. The nozzle of claim 1, wherein positioning of the distal-side channel-forming component is performed with respect to the nozzle cover.

5. The nozzle of claim 4, wherein the distal-side channel-forming component has a water-ejection portion having a protruding shape and provided with the channel-side water ejection opening, and the water-ejection portion is fitted in the nozzle cover-side water ejection opening.

6. The nozzle of claim 1, wherein positioning of the rear-side channel-forming component is performed in the axial direction of the nozzle cover, at a reference surface formed in a rear portion the nozzle cover.

7. The nozzle of claim 1, wherein the rear-side channel-forming component is fixed to the nozzle cover.

8. The nozzle of claim 1, wherein in a state where the nozzle cover has the distal-side channel-forming component assembled thereto, a fitting gap is formed between the distal-side channel-forming component and the nozzle cover, the fitting gap allowing the channel-side water ejection opening to be fitted in the nozzle cover-side water ejection opening.

9. The nozzle of claim 1, wherein the rear-side channel-forming component is fixed in place to the distal-side channel-forming component.

* * * * *